US011408639B2

(12) United States Patent
Consadori et al.

(10) Patent No.: US 11,408,639 B2
(45) Date of Patent: Aug. 9, 2022

(54) TANKLESS WATER HEATERS AND RELATED METHODS FOR RECREATIONAL VEHICLES

(71) Applicant: LIPPERT COMPONENTS MANUFACTURING, INC., Elkhart, IN (US)

(72) Inventors: Francesco Consadori, San Clemente, CA (US); Jerry Rennert, Elkhart, IN (US); Adrian Fernandez, San Clemente, CA (US); Oscar Solis Marquez, San Clemente, CA (US)

(73) Assignee: LIPPERT COMPONENTS MANUFACTURING, INC., Elkhart, IN (US)

( * ) Notice: Subject to any disclaimer, the term of this patent is extended or adjusted under 35 U.S.C. 154(b) by 409 days.

(21) Appl. No.: 15/999,736

(22) PCT Filed: Feb. 17, 2017

(86) PCT No.: PCT/US2017/018493
§ 371 (c)(1),
(2) Date: Aug. 20, 2018

(87) PCT Pub. No.: WO2017/143275
PCT Pub. Date: Aug. 24, 2017

(65) Prior Publication Data

US 2020/0400344 A1 Dec. 24, 2020

Related U.S. Application Data

(60) Provisional application No. 62/297,731, filed on Feb. 19, 2016.

(51) Int. Cl.

| | |
|---|---|
| ***F24H 1/00*** | (2022.01) |
| ***F24H 1/12*** | (2022.01) |
| ***F24H 9/20*** | (2022.01) |

(52) U.S. Cl.
CPC ..... *F24H 1/009* (2013.01); *F24H 1/124* (2013.01); *F24H 9/2035* (2013.01)

(58) Field of Classification Search
CPC F25B 2333/003; F25B 2700/01; F25B 33/00; F25B 2321/0251; F25B 2400/01;
(Continued)

(56) References Cited

U.S. PATENT DOCUMENTS 3,929,154 A * 12/1975 Goodwin ..... B60R 15/00 137/1
4,111,639 A * 9/1978 Matthews ..... F23N 5/123 431/25

(Continued)

FOREIGN PATENT DOCUMENTS

CN 201449033 U 5/2010
CN 201607020 U 10/2010

(Continued)

OTHER PUBLICATIONS

Office Action on corresponding foreign application (CA Application No. 3,014,815) from the Canadian Intellectual Property Office (CIPO) dated Apr. 17, 2020.

(Continued)

*Primary Examiner* — Michael G Hoang
*Assistant Examiner* — Andrew W Cheung
(74) *Attorney, Agent, or Firm* — Nixon & Vanderhye P.C.

(57) ABSTRACT

A tankless water heater for RV includes a heat exchanger disposed in a housing with an inlet cold water line and an outlet hot water line extending outside a front side of the housing. A burner, disposed in an operative relationship with the heat exchanger, is provided for heating water flowing through the heat exchanger and an exhaust system induces is provided to move exhaust fumes out a vent duct. The tankless water heater for RV can be partially automated (Continued)

using a microprocessor, which can receive signals from various sensors mounted with the water heater and can send control signals to control one or more parameters.

24 Claims, 7 Drawing Sheets

(58) Field of Classification Search
CPC ..... F23N 1/002; F23N 5/003; F23N 2229/02; F23N 5/245; F23N 2223/08; F23N 2225/19; F23N 5/105; F23N 5/082; F23N 5/107; F23N 5/123; F23N 5/203; F23N 1/005; F23N 1/007; F23N 2225/16; F23N 2229/00; F23N 2235/16; F24D 3/08; F24D 2200/04; F24D 11/002; F24D 15/02; F28D 21/00; F28D 15/00; F28D 15/02; F28D 20/003; F28D 20/0034; F28D 21/0003; F28D 7/06; F28D 7/12; F28D 1/0435; F28D 1/05366; F28D 1/05375; F28D 15/0275; F28D 2021/008; F28D 5/00; F28D 9/005; F28D 19/00; F28D 20/023; F28D 2020/0078; F28D 2020/0086; F28D 2020/0095; F28D 9/0025; B60F 3/00; B60F 3/0069; B60F 5/02; B60F 2301/04; B60F 3/0007; B60F 3/0061; B60F 3/003; B60D 1/167; B60D 1/64; B60D 1/62; B60D 1/01; B60D 1/245; B60D 1/30; B60D 1/36; F28F 13/18; F28F 2245/06; F28F 23/00; F28F 27/02; F28F 3/00; F28F 13/06; F28F 2250/04; F28F 9/0265; F28F 19/006; F28F 19/02; F28F 19/04; F28F 21/06; F28F 2220/00; F28F 2245/04; F28F 2270/00; F28F 2275/08; F28F 3/02; F28F 3/025; F28F 3/12; F28C 3/06; F24H 1/009; F24H 1/124; F24H 9/2035
USPC ..... 122/18.4
See application file for complete search history.

(56) References Cited

U.S. PATENT DOCUMENTS 4,223,692 A * 9/1980 Perry ..... F16K 17/30 137/460
4,550,689 A * 11/1985 Wolter ..... F24H 1/165 122/14.21
4,906,337 A * 3/1990 Palmer ..... C02F 1/16 126/362.1
5,039,007 A * 8/1991 Wolter ..... A47J 31/54 236/12.1
5,322,216 A * 6/1994 Wolter ..... G05D 23/1931 236/25 R
5,666,889 A * 9/1997 Evens ..... F24H 9/0042 110/190
5,809,941 A * 9/1998 Allaire ..... F24H 1/103 392/452
5,911,748 A * 6/1999 Boxum ..... F25D 23/10 62/244
5,960,157 A * 9/1999 McGraw ..... G05D 23/1909 392/308
6,363,971 B1 * 4/2002 Kaylan ..... F24C 3/12 137/883
6,728,600 B1 * 4/2004 Contaldo ..... F23N 5/203 700/274
8,276,548 B2 10/2012 Consadori et al.
2004/0067049 A1 * 4/2004 Woodward ..... B60H 1/00428 388/801
2005/0284948 A1 * 12/2005 Robinson ..... B60H 1/00364 237/12.3 R
2009/0179079 A1 * 7/2009 Ruijven ..... F24H 1/06 237/12.3 B
2010/0031900 A1 * 2/2010 Consadori ..... F24H 1/06 122/18.1
2012/0060772 A1 3/2012 Roy
2013/0214053 A1 * 8/2013 Narita ..... C02F 1/008 237/8 R
2014/0116357 A1 * 5/2014 Yano ..... F24H 9/2035 122/14.2

FOREIGN PATENT DOCUMENTS

CN 101688686 B 6/2013
GB 2455126 A 6/2009

OTHER PUBLICATIONS

Office Action on corresponding foreign application (CN Application No. 201780022060.5) from the China National Intellectual Property Administration (CNIPA) dated Apr. 14, 2020.
International Preliminary Reporton Patentability on corresponding PCT application (PCT/US2017/018493) from International Searching Authority (US) dated Aug. 30, 2018.
International Search Report and Written Opinion on corresponding PCT application (PCT/US2017/018493) from International Searching Authority (US) dated Jun. 19, 2017.
"GSWH-2 Owner's Manual" by Girard Products LLC, Aug. 1, 2015, http://www.dyersonline.com/downloadfile/download/aitfile/aitfile_id/3624/.
Office Action on corresponding foreign application (CN Application No. 201780022060.5) from the China National Intellectual Property Administration (CNIPA) dated Dec. 29, 2020.
Zhongwei, Han; "Technical Roadmap of the Civil Gas Appliance Industry"; Shunde District Gas Appliance Trade Association, Foshan; South China University of Technology Press; Jun. 2015; No. 140128; Guangzhou, China.
Office Action on corresponding foreign application (CN Application No. 201780022060.5) from the China National Intellectual Property Administration (CNIPA) dated Jun. 15, 2021.
Li, Peiyu; "The Principle, Use and Maintenance of Domestic Water Heaters"; Machinery Industry Press; Beijing, May 2000; pp. 83-84.
Examination Reporton corresponding foreign application (AU Application No. 2017221461) from IP Australia dated Dec. 1, 2021.

* cited by examiner

TANKLESS WATER HEATERS AND RELATED METHODS FOR RECREATIONAL VEHICLES

FIELD OF ART

The disclosed invention generally relates to gas fired tankless water heaters and is more specifically directed to tankless water heaters and related methods for use in recreational vehicles or utility vehicles and boats. Utility vehicles can include ambulances, fire trucks, and military vehicles where hot water is required for certain procedures.

BACKGROUND

Conventional tankless water heaters designed for the home or commercial buildings are typically bulky, heavy, and may run at high temperatures requiring special mounting fixtures and safety devices. For these reasons, such conventional tankless water heaters are not portable and not suitable for use in recreational vehicles (RVs) and boats.

Because space is at a premium in recreational vehicles and boats, hot water heaters utilizing tanks is not desirable, but nonetheless are today universally used, notwithstanding their weight and bulky configuration. A typical tank-based water heater unit includes a tank with capacity that provides 5 to 10 gallons of hot water with recovery times ranging from 30 to 60 minutes.

Hot water heaters such as described in U.S. Pat. No. 5,039,007, which provide for both hot water and heated air for space heating purposes, have never been developed commercially. Currently most tankless water heaters for recreational vehicles and boats on the US market are limited in market share due to high cost and poor performance, among others.

Tankless water heaters for recreational vehicles also face unique circumstances that fixed tankless water heaters do not. Fixed tankless water heaters have a water supply with generally constant flow rate and temperature. However, water sources for recreational vehicles may vary widely in flow, temperature, or both.

SUMMARY

Aspects of the present disclosure include a tankless water heater for a recreational vehicle (RV) comprising: a water run line comprising a water inlet, a seasonal flow control valve for controlling flow through the water inlet, and an inlet temperature sensor; a flow sensor in line with the water run line and the seasonable flow control valve; a heat exchanger for heating water flowing through the water run line; a burner to provide heat to the heat exchanger; an exhaust fan assembly to vent exhaust gas generated by the burner heating the heat exchanger; a water outlet temperature sensor in line with the flow sensor; an emergency cut off switch in line with the outlet water temperature sensor; a water outlet at an end of the water run line; and a microprocessor powered by a fulltime power supply source of an RV in electronic communication with the flow sensor, the exhaust fan assembly, and the inlet temperature sensor and the outlet temperature sensor; wherein the microprocessor is configured to adjust gas flow to the burner based on data from the flow sensor, the inlet temperature sensor, and the outlet temperature sensor. The tankless water heater can further comprise a housing having a frame housing the heat exchanger therein.

The flow sensor, the burner, the exhaust fan assembly, the inlet water temperature sensor, the outlet water temperature sensor, and the emergency cut off switch can all located in an interior of the housing.

The seasonal flow control valve can be located externally of a front housing panel.

The seasonal flow control valve can comprise an adjustment element. The adjustment element can be external to the housing and manually adjustable.

The emergency cut off switch can comprise a bi-metallic switch. The bi-metallic switch of the emergency cut off switch can activate when the run line temperature exceeds 150 degrees F., causing the microprocessor to shut all gas flow.

A further aspect of the present disclosure is a method for regulating water outlet temperature of a tankless water heater for a recreational vehicle (RV) comprising: setting an outlet temperature on a control panel; running water through a run line through a heat exchanger; adjusting gas flow to a burner based on an outlet temperature exiting the heat exchanger, based on inlet temperature entering an inlet to the tankless water heater, and based on volumetric flow rate entering the inlet; and wherein a microprocessor controls output of a linear valve based on the outlet temperature, the inlet temperature, and the volumetric flow rate; and wherein the microprocessor is configured to receive power from a fulltime power supply source on an RV.

The method can further comprising adjusting an inlet flow valve located upstream of a flow sensor. The adjustment of the inlet flow valve can be performed manually by turning an adjustable element located external of a housing panel.

A further aspect of the present disclosure is a method for regulating water outlet temperature of a tankless water heater for a recreational vehicle (RV) comprising: setting a water outlet temperature set point on a control panel; running water through a run line through a heat exchanger; adjusting gas flow to a burner based on water outlet temperature exiting the heat exchanger, based on water inlet temperature entering an inlet to the tankless water heater, and based on volumetric flow rate entering the inlet; and wherein a microprocessor controls a linear valve based on the water outlet temperature, the water inlet temperature, and the volumetric flow rate; and wherein the microprocessor is configured to receive power from a fulltime power supply source on an RV.

The method can further comprise activating an exhaust fan to exhaust gas out a duct.

The method can further comprise an ignitor located adjacent the burner to ignite a spark at the burner.

The method can further comprise an emergency cut off switch located downstream of the heat exchanger, said emergency cut off switch sending a signal to the microprocessor to close gas flow to the linear valve upon detecting a high temperature set point.

The method can further comprise a freeze prevention switch located downstream of the heat exchanger, said freeze prevention switch sending a signal to the microprocessor to allow gas flow to the linear valve upon detecting a low temperature set point.

The method can further comprise a solenoid valve to shut off gas flow to the burner upon receiving a signal from the microprocessor.

The method can further comprise a frame having the burner located therein and one or more panels mounted to the frame.

Method of making the tankless water heater for RV discussed herein are within the scope of the present disclosure.

A tankless water heater for recreational vehicle (RV) provided in accordance with aspects of the present disclosure comprises a housing for housing at least some of the following components: gas lines, water lines, sensors, switches, and electronics for controlling the flow and operation of both the water and the gas flowing through the water heater.

Note that a water heater for an RV is different from a portable water heater, which is understood to be portable for camping but not necessarily for the heavy duty use and more rigid requirements for RVs.

The housing can comprise a housing frame having at least one removable panel attached to the frame. In an example, a plurality of removable panels are mounted to the frame. A panel can represent a full or part of a side of the water heater, such as a left side or a right side. Any number of panels and sub-panels can be included to enclose the various tankless water heater components. A first panel can be used as a bottom of the tankless water heater for RV, as an example, and a second panel can be used as one of the sidewalls of the tankless water heater through which some of the components can extend. The descriptive terms "first" and "second" and so forth are understood to distinguish one component from another component only but do not structurally limit the components unless the context indicates otherwise.

In some embodiments, the tankless water heater may not have any housing panels at all and consists essentially of the frame for mounting the various components. In still other examples, the housing has less than the full panel sections needed to completely enclose the various components. For example, if six panels are needed to completely enclose the components within the housing, one or more of the six panels can be omitted to leave open sections of the housing for ready access to various components mounted with the housing.

A water supply inlet for introducing water to the tankless water heater can be located at an end of a tubing for routing the water to a heat exchanger inside the frame and/or the housing to heat the water. The tubing can be considered a run line for carrying the water between the inlet and an outlet.

An inlet flow valve can be placed downstream of the inlet to regulate fluid flow into the tankless water heater. The inlet flow valve or valve can be a manually operable control valve or an electronically adjustable control valve, The inlet flow valve can also be a block valve. The inlet flow valve may be referred to as a seasonal flow valve as its use can depend on the water supply temperature, which can change from season to season and from one location to the next. In an example, the inlet is part of the inlet to the valve rather than a nipple or an extension extending from the valve.

An inlet temperature sensor and a water flow sensor, such as a flow meter, can be positioned inline and downstream of the inlet flow valve. Downstream and upstream can be understood as the direction of flow such that if point B is downstream of point A, then point B is located, flow-wise, after point A. In some embodiments, the relative positions of the inlet temperature sensor and the water flow sensor may be reversed. In other embodiments one or more of the seasonal flow valve, inlet temperature sensor, and water flow sensor may be omitted from the tankless water heater for RV of the present disclosure. The inlet temperature and flow sensors can be used by the controller of the present disclosure to adjust certain flow parameters through the tankless water heater.

In an example, a tubing can extend away from the flow sensor towards the heat exchanger and the tubing can wrap around the exterior of the heat exchanger, which has a plenum or a skirt. The run line or tubing line wraps around the skirt and by conduction is heated by the skirt which then heats the inlet water running in the tubing, similar to a preheat. Because both the skirt and the tubing can be made from a highly conductive material, such as copper or copper alloy, heat energy is transferred by conduction from the skirt or plenum to the tubing and from the tubing to the water running therein. As a result, the water entering the tankless heater can be pre-heated before entering the heat exchanger. The tubing for carrying the water can then enter the heat exchanger so as to be heated by the heated gas from the burner.

Within the body or shell of the heat exchanger, a plurality of spaced apart fins are provided. The fins can be closely spaced or loosely spaced inside the heat exchanger to form baffles or channels to direct the flow of heated air from the bottom of the heat exchanger and then rising through the fins and out the top of the heat exchanger, elevation-wise. The number of fins can depend on the desired heat exchange rate by convection, conduction, and radiation exchanging with the interior run line of the tubing.

The tubing can pass through sections of the heat exchanger having the fins and wherein U-shaped returns can be provided to connect the parallel tubing sections in a turpentine fashion within the interior space of the heat exchanger. The number of fins and the total tubing length passing inside the heat exchanger can be selected to control the residual time of water travelling through the heat exchanger and the amount of heat transferring directly from the burner to the tubing and from the burner to the fins and then to the tubing.

In one embodiment, the tubing and the heat exchanger, such as the skirt on the exterior, are made from a highly conductive material, such as copper, brass, or their alloys. In other embodiments, the heat exchanger and the tubing may made be made from other corrosive resistant materials that are able to withstand the direct or indirect heat of the burner.

In some examples, inlet and outlet headers are provided within the heat exchanger. For example, the tubing can direct inlet water to the inlet header that then separates the single inlet feed line into multiple parallel run lines inside the heat exchanger. The multiple run lines can then be routed to an outlet header that then consolidates the various run lines into a single outlet line, which then exits the heat exchanger and flow into the discharge or outlet line.

In some embodiments, the tubing wraps around the skirt of the heat exchanger twice in the form of loops, such as continuous loops or in sections that are joined. In other embodiments, the tubing may have fewer than two loops wrapping around the skirt of the heat exchanger or more than two loops wrapping around the skirt of the heat exchanger. The length of tubing and the number of loops formed or wrapped around the heat exchanger can depend on the residual time desired to route the water through the heater, the number of tie-ins needed to connect the various component, and the desired preheat, among others The tubing run line inside the heat exchanger exits or leaves the heat exchanger near or at an exit point, which in one embodiment can be located near an upper side section of the heat exchanger. A temperature switch can be connected inline and downstream of the exit point. Output from the temperature switch can be used for freeze prevention, as further discussed below.

A hot water temperature probe can be connected downstream of the freeze prevention switch and an emergency cut-off (ECO) switch can be connected downstream of a hot water temperature probe. The tubing can terminate with an outlet, which can be positioned above the inlet, elevation-wise. In some examples, the inlet is located above the outlet, elevation-wise. The inlet and the outlet can alternatively be mounted side-by-side, approximately at the same elevation. In other examples, the inlet and the outlet can be mounted along different sides of the housing or frame. In still other examples, additional probes and/or sensors can be connected in-line with the tubing for sensing and controlling or regulating other flow functions.

The various connections of the various components of the present tankless water heater can be threaded, welded, using mating flanges, or combinations thereof. In some examples, a threaded bore is provided on a side of a fitting, such as a threaded socket or a threaded thermowell, for receiving a probe, which can include a thermostat, a flow sensor, or other sensing devices. Optionally, welding may be used to connect the various components and tubing sections.

In some embodiments, the order of the freeze prevention switch, the hot water temperature probe, and the emergency cut-off switch may be rearranged in a different sequence given that all of the components are mounted in-line and between the heat exchanger and the outlet. Thus, the ECO switch can be located immediately downstream of the heat exchanger, then the outlet temperature probe, then the freeze prevention switch downstream of the outlet temperature probe.

In still other embodiments, one or more of the freeze prevention switch, the hot water temperature probe, and the emergency cut-off switch may be omitted from the tankless water heater for RV and the water heater used in a very basic mode or in manual mode. When used, the freeze prevention switch and the ECO switch are similar but have different set points. The freeze prevention switch is configured to switch or output a signal when the temperature reaches a low temperature set point so that the microprocessor can initiate the burner. In contrast, the ECO switch is configured to switch or output a signal when the temperature reaches a high temperature set point so that the microprocessor can shut off the inlet gas flow.

The burner can be positioned immediately adjacent the heat exchanger and provides the heating source to heat the exchanger. In an example, the burner is positioned below the heat exchanger, elevation-wise, so that hot air generated from the burner rises through the heat exchanger. In an example, the burner can have a wide tip having multiple gas discharge holes to provide a large distributed flame profile. The tip can comprise a plurality of plate-like structures positioned side-by-side with each plate having a plurality of discharge holes formed on an edge thereof for gas flow. The tip can alternatively have a circular ring shape, a rectangular shape, an elliptical shape, a square shape, or other shaped tips provided the number of discharge holes are selected to produce sufficient BTU for a given gas type and gas pressure.

An exhaust system comprising an exhaust collector, an air pressure switch, and a vent duct can be provided to direct exhaust fumes created by the burner away from the housing of the tankless water heater for RV. Additional ducting may be provided to direct the exhaust gas through the vent duct and out, such as out an opening to an exterior of the mobile or recreational vehicle. In some examples, an induced draft fan, a force draft fan, or both can be incorporated to move gas through the tankless heater. As shown, the tankless hot water heater has an induced draft fan for drawing exhaust gas away from the heater. The air pressure switch can be positioned to sense air or gas flowing through the exhaust system. If the pressure from the switch produces a low flow signal, the microprocessor can interpret the data as insufficient air flow and can shut off the gas flow to the heater.

Various functions of the tankless water heater, such as set temperature, flow rate, and flow for freeze prevention, may be controlled using a controller having a microprocessor. The microprocessor in the controller can act as a gateway for receiving signals and data from the various sensors and can be programmed to control operation of various components of the tankless water heater for RV based on the received signals and data, as further discussed below. For example, based on the temperature data received from one of the thermostats or probes, the microprocessor can send control signals to a gas regulator to modulate gas flow feeding the burner.

As shown, the water supply inlet can have a standard fitting to readily accept a water feed line or inlet water source. For example, the inlet can comprise an industry standard connection fitting for attaching to a water supply or cold water supply line. The hot water outlet similarly can comprise an industry standard connection fitting for attaching to plumbing lines that then carry heated water to user stations, such as to sinks and baths/showers located elsewhere in the vehicle on which the tankless water heater for RV is mounted.

The seasonal flow valve can be manually adjusted by a user to either reduce or increase the volume flow rate of the incoming water supply through the tankless water heater. This ability to adjust the seasonal flow valve allows the tankless water heater for RV of the present disclosure to operate with an incoming water supply having a temperature falling within a relatively wide range without requiring an increase in heat output from the burner of the tankless water heater for RV to still provide efficient heating.

In other embodiments, the seasonal flow valve may be automatically controlled by the controller based on various input data and signals from, for example, the flow valve, the input water temperature sensor, and the output water temperature sensor. For example, the flow valve can be connected to a solenoid and controlled by the controller, which can open or close the flow valve depending on the temperature of the water entering the inlet and/or the set temperature of the water at the outlet.

A control element, knob, or adjustment element on the seasonal flow valve may be turned one direction to restrict the incoming flow volume and the opposite direction to increase the incoming flow volume. In other examples, a valve stem of the flow valve can simply translate along an axis of the valve stem rather than rotate to control flow through the valve, such as when actuated by a motor or a solenoid. Other embodiments of the tankless water heater for RV can exclude the seasonal flow valve.

If incoming water temperatures are within a range of approximately 50 degrees Fahrenheit ("F") to about 80 degrees Fahrenheit, such as during cooler seasonable periods, the tankless water heater may operate without any adjustment to the seasonal flow valve. In the water inlet temperature range of about 50 degrees F. to about 80 degrees F., the controller can control other parameters of the heat exchanger to produce water at user-specified temperatures of up to about 120 degrees Fahrenheit at the outlet without having to manipulate the seasonable flow control valve, as will be described in further detail below.

When the inlet water temperature falls outside of this range, the seasonable flow control valve can be manipulated, such as turned or actuated to further open or close, so that the water temperature at the outlet can reach up to about 120 degrees F. In other examples, the portable heat exchanger can be sized to yield the desired hot water temperature output for a different water range without having to adjust the seasonable flow control valve. The range of about 50 degrees Fahrenheit ("F") to about 80 degrees Fahrenheit therefore represents an exemplary range only that can be sized before resorting to any adjustment to the seasonal flow valve.

Outside of the approximate 50-80 degree Fahrenheit temperature range, the seasonal flow control valve may be used, such as turned or actuated to further open or close, to effectively extend the range of incoming water temperatures useable with the tankless water heater for RV without requiring the burner to yield additional heat capacity or requiring over-sizing the burner during initial assembly but operating the burner in a normally throttled state. When the incoming water supply is less than 50 degrees Fahrenheit, such as during the winter season, the inlet water flow rate may be restricted by the seasonable flow control valve so that there is less water moving through the heat exchanger at any given time. With a reduced volume of water flow rate to heat, the heat exchanger can apply the same amount of energy to the reduced water flow rate as compared to a larger water flow rate but at a higher inlet temperature, such as during the summer season.

By reducing the inlet flow rate when the water temperature drops, this reduces the water mass to be heated by the burner to raise the water temperature over a larger temperature delta, such as for a lower starting temperature due to the cooler season to the same set temperature of 120 degrees F., as an example, and allows the tankless water heater of the present disclosure to operate with the same burner and rated BTU output in varied environments normally not experienced with residential mounted tankless water heaters. In other words, the present tankless water heater of the present disclosure can raise water temperature over a greater temperature differential or delta T between the inlet and the outlet by reducing the inlet volume flow rate to allow the tankless water heater for RV to achieve the desired output temperature by the user even when incoming water supplies has a temperature below 50 degrees Fahrenheit.

The converse may be true of incoming water supplies with temperatures greater than 80 degrees Fahrenheit. The flow volume may be increased at the seasonal flow control so that a greater flow volume of incoming water can flow through the heat exchanger. Applying energy to an increased volume of water can result in a lower water temperature differential or delta T at the outlet but still acceptable if the inlet temperature is on the high side. This arrangement allows for water temperature control to be based at least in part on water volume rather than controlling temperature differential based on BTU output at the burner. In some examples, temperature control of the water outlet can be based on both, such as based on regulating the inlet volume flow rate of the inlet water and the amount of BTU fired at the burner.

Unlike a tankless water heater installed in a permanent structure, such as in a home which has a generally stable water supply temperature and pressure, a recreational vehicle with a tankless water heater moves from one water supply source to another different water supply source when on the road travelling from point A to point B. The tankless water heater for RV should be able to produce water at the desired temperature from widely varying water supply temperatures while still maintaining a relatively small size or profile to fit within the portable environment of the recreational vehicle. The ability to control the volume of water entering the tankless water heater for RV allows the tankless water heater for RV to operate over a greater range of water supply temperatures without requiring the production of additional heat energy, which would require a larger burner and possibly a corresponding larger fuel supply source and larger housing to accommodate.

As shown in FIG. 1 and further discussed below, the water supply inlet, the seasonal flow valve, and the hot water outlet can be located externally of the housing panels, such as externally of the front panel, of the housing for quick access by a user. Optionally, the tubing and the vent can be located, at least in part, outside of the panels of the housing to facilitate assembly and maintenance, among other things.

Both the water supply inlet and the seasonal flow valve may be located near the bottom of the tankless water heater for RV and externally of the front panel or elsewhere on the same side of the housing or frame or on different sides of the housing or frame.

The gas tubing connects the gas inlet to a linear valve and the linear valve is connected in line to a solenoid valve and to the burner. In an example, the linear valve is provided by CAE, model number CPV-H2467AY, and can be used to control gas flow through the tankless water heater of the present disclosure. Other linear or equal percentage valves are contemplated for use with the present system to regulate gas flow through the tankless water heater based on various sensed parameters, such as water flow, inlet and/or outlet water temperatures.

The linear valve and solenoid valve are connected to the microprocessor of the controller, which is programmed to control the linear valve and the solenoid valve based on data and signals received from sensors. In general, the solenoid valve can be an on/off valve only while the linear valve can be and on/off valve and can be regulated to control gas flow from full flow to fully shutoff, as described in more detail below. Together, the solenoid valve and the linear valve can act as a dual emergency shut off valve when both are in the off position. The tankless water heater may accept propane gas only, such as while travelling with propane tanks or when parked at a camp site.

The exhaust system of the present disclosure can include an exhaust collector positioned at or proximate the top of the housing unit to collect fumes rising from the burner. Fan blades powered by a motor located below the fan can direct fumes through the vent where the fumes exit the tankless water heater for RV. The vent can extend, at least in part, outside of the housing. The fan motor can be connected to the microprocessor of the controller, which is configured to operate the motor to turn the fan on and off based on signals sent to the microprocessor from the one or more sensors.

The water supply inlet, hot water outlet, and seasonal flow valve can extend away from the front panel of the tankless water heater. These parts may be located exterior to the housing. In an example, both the inlet and outlet nozzles point in in the same direction.

The vent or vent duct, which can shape as a hollow cylinder, also extends away from the housing of the tankless water heater for RV. In an example, the vent duct has an end opening that points in the opposite direction to the water inlet.

A controller housing with a removable cover and the microprocessor located therein can be located on the same side as the vent duct, such as below the vent duct. In some embodiments, the cover of the controller housing is flushed with the panels of the heater housing.

The water supply inlet and seasonal flow valve can be connected in line on or near the bottom left of the front panel of the housing. In some examples, the inlet and the valve are located with the housing frame and the front panel is removable from the frame. Above the water supply inlet is the hot water outlet, which in other embodiments can locate elsewhere on the housing. On the bottom right side of the frame is the gas inlet. Above the gas inlet is a DC connector port for powering the tankless water heater for RV. In an example, the DC connector port is a passage or bore through the housing having a plastic ferrule that allows one or more cables to pass therethrough for connections between the electric system of the water heater, such as the controller, and the vehicle's electric system.

The controller and microprocessor of the present tankless water heater 100 can take different voltages, such as 12 Volt DC to 24 Volt DC. Generally, 12 Volt DC is produced by the on-board power system of a recreational vehicle to power various auxiliary devices. The power can be tied or linked to the ignition system or supplied from a battery bank with fulltime power, as is well known in the RV industry. The battery bank that supplies fulltime power can be charged by the vehicle's generator or by plug-in AC power when the RV is plugged into an AC source. Above the DC connector can be an I/O connector port that can be used to set control parameters for the controller Like the DC connector port, the I/O connector port can be a passage or bore through the housing having a plastic ferrule that allows one or more cables to pass therethrough for connections between the electric system of the water heater, such as the microprocessor, and a control panel, which can be mounted remotely from the tankless water heater, such as near the kitchen or the vehicle dashboard.

A control panel can comprise a housing comprising a display and connection cable to connect the control panel through the I/O port and to the controller. The display can be an LCD, an LED, or any commercially available display type and can include fields or areas for displaying different information. The housing of the control panel can be sized and shaped to be handheld or can be mounted on a surface or a panel.

In one embodiment, one area of the display may provide information regarding the temperature of water exiting the hot water heater. The hot water temperature probe can provide this data to the microprocessor, which can be picked up and displayed by the control panel when the control panel is plugged into the connector port on the frame of the housing.

Another area of the display may include icon graphics. In an exemplary embodiment, a plurality of icons can be included to display operating parameters, states, or conditions of the various components of the tankless water heater, such as to indicate whether the fan is operating, whether the igniter on the burner is operating, and/or to indicate that water is flowing through the water heater, among other information and icons. The display is sized and shaped to be readily and easily visible to a user. A dimmer switch can be included to change to light output of the display.

The microprocessor of the controller can be programmed to diagnose problems and store the information in a local memory drive as error codes. The control panel can display the error codes that can then be used by a technical service personnel to troubleshoot the tankless water heater for RV. In one embodiment, the microprocessor is programmed to track a plurality of different error codes, such as five or more codes. The codes can be numbered consecutively from a zero to N in increment of one. If the display has limited fields and the error code is limited to a single digit, then a number, such as "n," may be used, which can represent, as an example.

If a failure were to occur in the tankless water heater of the present disclosure, the microprocessor can detect the error and the specific cause can be indicated by the error on the Display to display one of the following exemplary causes and codes.

The control panel may also include plurality adjustable switches in the form of buttons. The buttons may be arranged anywhere on the housing of the control panel and usable by a user to control operating parameters of the tankless hot water heater for RV. In one embodiment, the buttons are placed on the same side as the display. In other embodiments, the buttons may be placed on sides that are different than the side with the display. For example, the control panel can include a first button for changing the temperature display between Celsius and Fahrenheit. The control panel may also include a power button for powering the tankless water heater for RV on and off. The control panel can further include second and third buttons for changing or setting the output temperature of the hot water.

The buttons can be of the permanent or hard button type and can have graphics printed on them to inform the user of parameter or information that they control or can be of the soft type that can vary depending on the screen. The buttons for controlling the water output temperature can have an up arrow or a down arrow graphic.

Further, light emitting diodes (LED) or other light producing devices may be associated with the buttons to indicate that a particular button is operating or that the function associated with the particular button is active. For example, an LED may stay lit once the power button has been pressed, and the tankless water heater for RV remains powered on. The buttons may be of the same size or may be of different sizes relative to one another.

In an exemplary embodiment, the controller and microprocessor of the tankless water heater are connected to the onboard fulltime DC power supply of the recreational vehicle and not dependent on the car ignition system. By connecting to the vehicle's fulltime power, the controller is always powered and various set points using the control panel and various parameters and data used by the microprocessor are maintained or saved. In other examples, the controller is equipped with auxiliary memory that stores set points and parameters and can retain the information even when power is disconnected to or from the controller. When auxiliary memory is incorporated, the controller can be supplied with vehicle's generator power.

The tubing, the inlet valve, and sensors of the tankless water heater for RV can be positioned upstream of the heat exchanger. The water supply inlet can include a quick connect coupling or a threaded collar. The seasonal flow valve can comprise a manually tunable ball valve, gate valve, or glove valve with a rotatable knob. The inlet can be the valve inlet, such as being part of the valve body of the valve. A support flange having two or more holes for use with screws may be provided in line with the tubing to secure against the frame of the housing and support the tubing and the various components.

The inlet temperature sensor is shown as a thermocouple threaded to a female thermowell. The flow sensor downstream of the inlet temperature sensor can embody any number of types, such as a differential pressure flowmeter, a velocity flowmeter, or a mass flow meter type. As shown, the flow sensor can be an Aiber 2 mPa-5/12 VDC type. A bend can redirect the tubing upwards toward the top of the tankless water heater for RV to connect to the heat exchanger.

The tubing and sensors of the tankless water heater for RV can be positioned in line after the heat exchanger. The tubing exits or leaves the heat exchanger and has a freeze prevention switch connected in-line therewith, which is configured to initiate a reaction in the microprocessor when activated at a certain set point to prevent freezing.

A hot water temperature probe and an emergency cut-off switch can be connected in-line and downstream of the freeze prevention switch. A right angle bend changes the direction of the tubing and the tubing terminates with at hot water outlet. A support flange can be provided adjacent the water outlet for connecting to the frame of the housing and supporting the tubing and the various components. In some embodiments, the hot water outlet may terminate externally of the front panel of the housing while in other embodiments, the hot water outlet may be flushed with the front housing panel.

In some embodiments, the tankless water heater for RV may omit one or more of the freeze prevention switch, the hot water temperature probe, and the emergency cut-off switch.

The controller housing of the present disclosure can have a base and a cap or cover attached to the base through conventional means. The base has flanges for attaching the controller housing to the water heater housing. A plurality openings or ports of similar or different sizes can be provided in the housing to terminate various cables and wires, as further discussed below.

A power terminal can be provided for connecting a power cable between the power terminal and a DC power supply source, such as a fulltime battery power supply source. The PCB has a grounding terminal for use with a grounding cable to ground the circuit.

An ignition terminal can be provided for the ignitor high voltage wires, which supplies the necessary power to two ignition sparks located at the ends thereof to supply the ignition source for the burner. The flame feedback terminal can be located adjacent the ignition terminal and is provided for use with a furnace for flame sensor connected to the flame feedback wire.

The air pressure switch can be connected using a wind and pressure switch wire to the air pressure terminal. The remote control can be connected to the I/O port of the PCB via the remote connection cable. The outlet temperature probe can connect to the outlet temperature terminal via the outlet temperature cable and the inlet temperature probe can connect to the inlet temperature terminal via the inlet temperature cable.

A multi-pin connection terminal is provided on the PCB to connect to the solenoid valve via a first cable and the linear valve via another cable, such as a second cable. The ECO switch and the freeze prevention switch can connect to the multi-pin connection terminal via cable and cable, respectively.

The fan assembly or exhaust system comprising fan blades and a motor for rotating the fan blades can be connected to the power and control terminal on the PCB via a fan system cable. The power and control terminal are configured to supply DC power to the motor and to terminal power pursuant to the control supervision of the microcontroller.

A user may connect a control panel to the tankless water heater for RV via a wire or cable connection, placing the control panel in electrical communication with the microprocessor. In other embodiments, the control panel may be connected wirelessly to the microprocessor or is integrated with the housing. As described above, the microprocessor is programmed to receive signals from the inlet temperature sensor, which detects the temperature of the water inlet. The microprocessor can provide the control panel with the temperature information to display temperature on the display screen of the control panel.

Based on the temperature of the water displayed on the control panel, a user may wish to set or adjust the temperature of the outlet water. Using the buttons on the control panel, the user can adjust the temperature set point, such as to 115 degrees F., which is then sent to the microprocessor.

The microprocessor receives the temperature set point from the buttons on the control panel and based on the set point and other input from other sources, such as the inlet temperature and the flow rate through the system, the microprocessor can use an algorithm programmed for the particular linear valve and downloaded to the microprocessor to calculate control points or parameters. For example, the results of the algorithm can be used by the microprocessor to operate the tankless water heater for RV to achieve the water output selected by the user.

In an example, the microprocessor uses the results of the algorithm to operate the linear valve, such as to modulate the gas flow rate through the linear valve, to control the heat energy output of the burner, which directly effects how much heat is imparted to the water flowing through the tubing and through the heat exchanger. In some embodiments, the microprocessor, in implementing the results of the algorithm, can control the seasonal flow valve at the inlet, which can be connected to a solenoid and the microprocessor can control the movement of the solenoid to control flow through the seasonal flow valve.

In an example, the microprocessor can use an algorithm based on input from a plurality of factors to produce results that are then used to control the linear valve. Optionally, the results can be used to control various other components of the tankless water heater for RV in order to achieve the desired output temperature, such as to modulate other solenoid valves or flow valves to control the water flow rate through the tankless water heater.

One input that can be used by the algorithm, as described elsewhere herein, is the temperature reading of the incoming water supply. The microprocessor can receive this information from the inlet temperature sensor, which reads the water temperature of the inlet water flowing across the inlet temperature sensor.

Another input that can be used by the algorithm is the volumetric flow rate of water running through the tankless water heater for RV. The flow volume can be sensed by the flow sensor upstream of the heat exchanger and the information can be sent to the microprocessor to compute the output set point for the linear valve, which can control the gas flow rate feeding the burner, as further discussed below.

Another input that can be used by the algorithm running in the microprocessor is the outlet water temperature as sensed by the outlet temperature sensor. The microprocessor can receive this information from the outlet temperature sensor, which reads the water temperature of the water flowing out of the heat exchanger.

Another input that can be used by the algorithm is the volumetric flow rate of the gas supplied to the burner. The volumetric flow rate of the gas feeding the burner can be controlled by the linear valve. In some embodiments, the microprocessor may use fewer or more factors than three to control the temperature of the water output from the tankless water heater for RV.

Once a user sets the portable tankless water heater to a desired water output temperature using the control panel, switch, button, dial meter, etc., the user may operate a sink or a shower in the recreational vehicle to start the flow of water through the tankless water heater and out the faucet and/or shower head. By opening a valve to draw water out the tankless water heater, the user starts the water flow through the water heater.

In the tankless water heater for RV of the present disclosure, the flow sensor senses the flow of water and sends a signal to the microprocessor to indicate water flow. The microprocessor can output a signal to the control panel to display a faucet icon or other indicators, indicating that water is flowing through the tankless water heater for RV. The water inlet temperature and/or the outlet water temperature can also be shown on the display of the control panel.

Depending on the severity of a potential leak in the vehicle water flow system, it might be possible for a user to detect the leak using reading, read-out, or a message from the flow sensor to show water flowing through the tankless water heater for RV.

Based on the outlet temperature set point set by the user on the control panel, the microprocessor can send signals to the linear valve to fully open, fully close, or modulate the linear valve to change the fuel gas volume throughput through the tankless water heater, such as through the burner. If the water heater is not previously on or in service, the microprocessor can send a signal to an ignitor to generate a spark or ignition source.

Feedback from the ignitor and/or the burner can be provided by a flame sensor through the flame feedback wire and to the flame sensor terminal on the microprocessor. The flame sensor can confirm that the ignitor has lit the gas and produced a flame on the burner. The flame sensor can be located adjacent or near the ignitor and the burner. The microprocessor can inform the user that the burner flame is lit by providing an output to the control panel to display a flame icon or other indicators.

Once the microprocessor has received a signal that the ignitor has successfully ignited the burner, the microprocessor can send a signal to turn off the ignitor or the ignitor can timeout after a short programmable period.

The microprocessor can control the exhaust system to ensure that exhaust gas is properly directed out the exhaust duct. In an example, the fan motor is energized to rotate the fan blades to direct exhaust fumes created by the burner out through the vent. The combination motor and fan blades act as an induced fan to draw exhaust gas out the system, and out through the vent.

The microprocessor can also send a signal to the control panel to display an icon of a fan or other indicators to indicate that power is flowing to the fan motor, and, by extension, that the fan is running and moving the fumes created by the burner.

Based on readings from the flow sensor, the inlet temperature sensor, and the outlet temperature sensor, the microprocessor can determine if any adjustment to the linear valve may be needed to change the gas input to the burner to obtain the output temperature set point set by the user using the remote control.

If the results from the algorithm indicate that an adjustment is required to the gas flow through the linear valve in order to achieve the desired output set point, the microprocessor sends a signal to the linear valve to open or close the valve by some degree or amount, as required to change the gas flow. The increased or reduced flow of gas correspondingly increases or reduces the heat produced by the burner. The heat energy of the flame from the burner through convention to the skirt of the heat exchanger and to the tubing wrapped around the skirt of the heat exchanger and within the heat exchanger therefore affects the conductive heat transfer between the heat exchanger, the tubing, and the water.

The linear valve may be adjusted across a range of flow values from fully off to a maximum flow condition. Because the linear valve may be turned fully off, it may also act as a secondary emergency cut off for the gas flow within the tankless water heater for RV. The solenoid valve, which only moves between a fully open or fully closed position, serves as the primary emergency cut off for the gas supply line. Thus, if the system exceeds a high water temperature alert or a no air flow alert, as examples, the microprocessor can act to close the solenoid valve and fully close the linear valve to prevent system overheating. The microprocessor can also be programmed to reset itself when the various sensor readings are within permissible reset points.

After the water passes through the heat exchanger, the heated water flows across the downstream hot water temperature probe. The hot water temperature probe provides a signal to the microprocessor indicating the temperature of the water exiting the heat exchanger. As described elsewhere, the water output temperature is then used in the algorithm to adjust the gas supplied to the burner by adjusting the linear valve to ultimately achieve the outlet temperature set point. The temperature of the water output can be displayed on the screen of the control panel.

If the temperature of the output hot water is too high, and the hot water temperature probe sends a signal to the microprocessor indicating that the temperature of the output hot water is too high, the microprocessor can send a signal to the gas solenoid valve to close the solenoid valve and to fully close the linear valve, thereby turning off the burner.

Both the linear valve and the solenoid valve can be configured to default to the off position unless current is applied to them, such as in a power outage situation or when the microprocessor should fail. This setting or configuration can be viewed as a built-in safety feature. Thus, unless the tankless water heater for RV is powered, both the linear valve and solenoid valve can block the flow of gas through the gas line to prevent any gas from flowing out of the burner and presenting a potential safety hazard.

Heated water flows across the water temperature probe and across the redundant emergency cut off (ECO) switch downstream of the heat exchanger. The ECO switch can be of a bi-metallic switch type that is normally in an open position. The bi-metallic switch can close when the temperature of the copper tubing exceeds a certain high temperature point, such as above about 150 degrees, such as about 156 degrees F. As described above, the microprocessor is connected to the redundant emergency cut off switch. When the switch activates or closes, a signal is sent from the redundant emergency cut off switch to the microprocessor to indicate that the redundant emergency cut off switch has or is activated. Based on this signal, the microprocessor can send a signal to the linear valve and the solenoid valve to shut off the gas to the burner so that the burner and the heat exchanger do not overheat the water in the tankless water heater or generate too much heat to the various components.

The microprocessor can also send a signal to turn off the exhaust system when the burner shuts down, as there are no fumes to exhaust.

The freeze prevention thermostat mounted in line with the emergency cut off switch is configured to send signals to the microprocessor through a connection based on the position of a bi-metallic switch in the freeze prevention thermostat, similar to the ECO switch but has different service ratings for cold temperature applications. The bi-metallic switch in the freeze prevention thermostat is normally in the open position. The bi-metallic switch closes when a temperature of the copper tubing to which the freeze prevention thermostat falls to a pre-determined low temperature, such as below 38 degrees F. The connection of the freeze prevention thermostat and the microprocessor provides one way communication, with signals passing from the freeze prevention thermostat to the microprocessor.

In one embodiment, the metals of the bi-metallic switch in the freeze prevention thermostat can close the switch at 38 degrees Fahrenheit as a signal for the microprocessor to start the burner to warm the system and can open the switch above 38 degrees Fahrenheit. In other examples, the operating temperature range can differ or can be adjusted to a different set value.

The freeze prevention thermostat measures the temperature of the copper tubing mounted in the tankless water heater for RV downstream of the heat exchanger. When the temperature of the copper tubing falls below 38 degrees Fahrenheit, the switch closes, sending a signal to the microprocessor.

In other embodiments, the bi-metallic switch in the freeze prevention thermostat can be set to activate at a temperature in the range of 33 to 50 degrees Fahrenheit, with a range of 33 to 40 degrees Fahrenheit being more preferred. In other embodiments, the bi-metallic switch in the freeze prevention thermostat can be set to de-activate at a temperature in the range of 40 to 65 degrees Fahrenheit, with a range of 50 to 60 degrees Fahrenheit being more preferred.

The microprocessor receives the signal from the freeze prevention thermostat, and based on that signal, can output signals to the linear valve, the solenoid valve, the ignitor, and the exhaust system. These signals allow the flow of gas to the ignitor, operate the ignitor to light the burner, and begin operating the exhaust system to exhaust the fumes created by the burner.

The burner heats water in the heat exchanger of the tankless water heater for RV. Because copper conducts heat efficiently, in the embodiments of the tankless water heater for RV which uses copper tubing, the heating of the tubing in the housing of the tankless water heater can conduct heat beyond the tankless water heater for RV to other tubing sections of the vehicle to warm the interconnected tubing throughout.

The burner can remain lit, thereby heating the tubing and the tubing transferring that heat beyond the tankless water heater for RV until the microprocessor receives a second signal from the freeze prevention thermostat. When the copper tubing reaches 58 degrees Fahrenheit or some other set point, the second metal in the bi-metallic switch causes the switch in the freeze prevention thermostat to open. When the switch opens, it sends the second signal to the microprocessor. When the microprocessor receives this second signal, it sends corresponding signals to the linear valve and the solenoid valve to shut off the gas, and thereby the burner, as well as to the exhaust system, turning the exhaust system off as well.

BRIEF DESCRIPTION OF THE DRAWINGS

These and other features and advantages of the present device, system, and method will become appreciated as the same becomes better understood with reference to the specification, claims and appended drawings wherein:

DETAILED DESCRIPTION

The detailed description set forth below in connection with the appended drawings is intended as a description of the presently preferred embodiments of tankless water heater for RVs provided in accordance with aspects of the present assemblies, systems, and methods and is not intended to represent the only forms in which the present devices, systems, and methods may be constructed or utilized. The description sets forth the features and the steps for constructing and using embodiments of the present assemblies, systems, and methods in connection with the illustrated embodiments. It is to be understood, however, that the same or equivalent functions and structures may be accomplished by different embodiments that are also intended to be encompassed within the scope of the present disclosure. As denoted elsewhere herein, like element numbers are intended to indicate like or similar elements or features.

Figure 1:
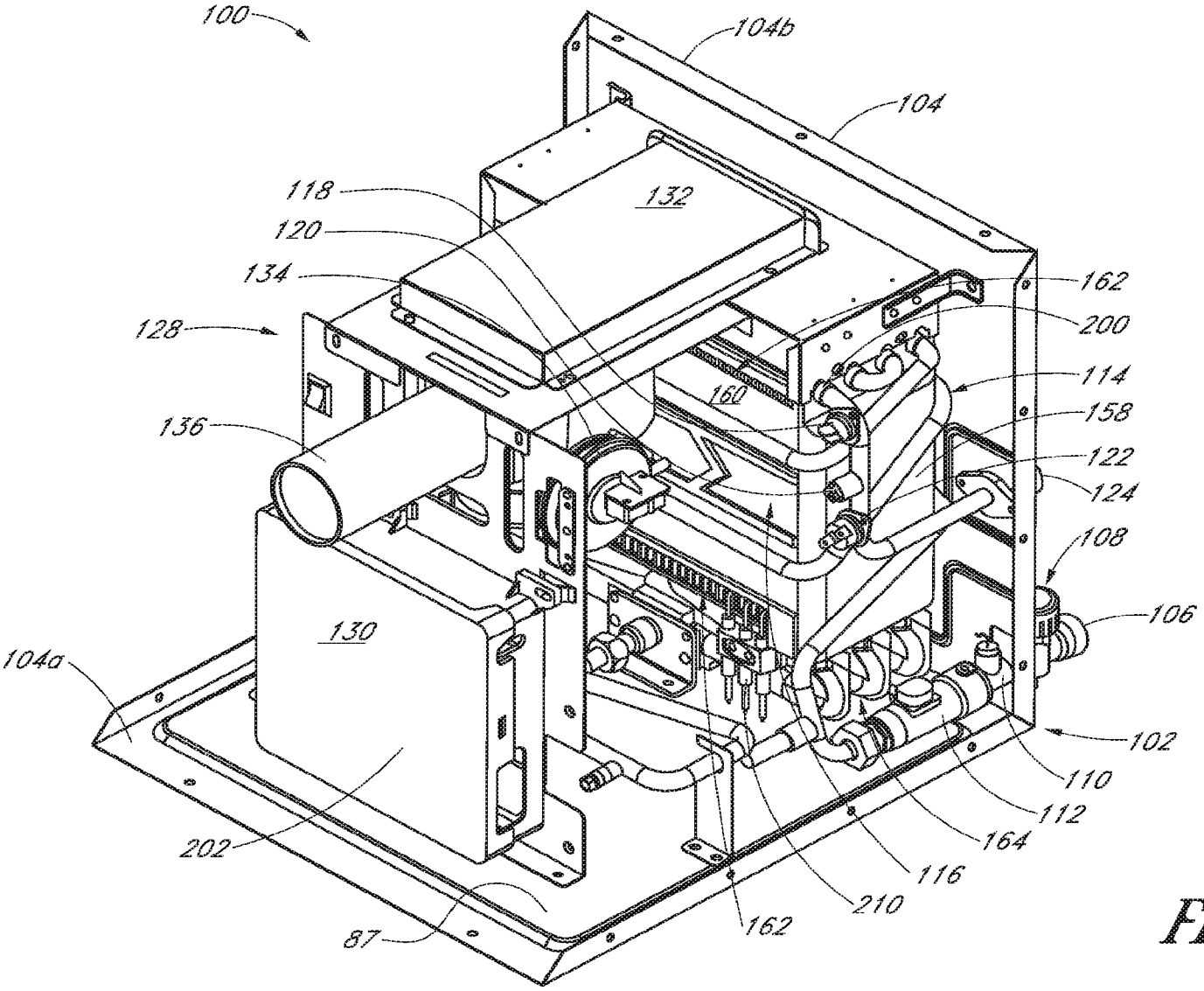
FIG. 1 is a rear perspective view of a tankless water heater for RV shown without panels to expose the various internal components of the water heater.

With reference now to FIG. 1, a perspective view of a tankless water heater for recreational vehicle (RV) 100 provided in accordance with aspects of the present disclosure is shown, which comprises a housing 102 for housing gas lines, water lines, sensors, switches, and electronics for controlling the flow and operation of both the water and the gas flowing through the water heater 100, as further discussed below. Note that a water heater for an RV is different from a portable water heater, which is understood to be portable for camping but not necessarily for the heavy duty use and more rigid requirements for RVs.

The housing 102 comprises a housing frame 87 having a plurality of removable panels 104 mounted thereto with only two shown for clarity. Any number of panels and sub-panels can be included to enclose the various tankless water heater components. The first panel 104*a* can be used as the bottom of the tankless water heater for RV and the second panel 104*b* can be used as one of the sidewalls of the tankless water heater through which some of the components can extend, as will be discussed in more detail below. The descriptive terms "first" and "second" and so forth are understood to distinguish one component from another component only but do not structurally limit the components unless the context indicates otherwise.

For purposes of the following discussions, the second panel 104*b* of the tankless water heater shown in FIG. 1 can be considered the front of the tankless water heater 100. The side directly opposite the second panel 104*b* can be considered the back of the tankless water heater 100. One of ordinary skill in the art will recognize that these directional assignments to the components of the tankless water heater are for purposes of description only as the tankless water heater for RV may be installed in any orientation that allows for proper operation.

In one embodiment, the tankless water heater 100 is installed in the orientation shown in FIG. 1. In other embodiments, the tankless water heater for RV is installed in a different orientation that allows proper operation relative to the recreational vehicle, including installation such that the second or front panel 104*b* faces north, south, east, west, or anywhere in between.

In some embodiments, the tankless water heater 100 may not have any housing panels 104 at all and consists essentially of the frame 87 for mounting the various components. In still other examples, the housing 102 has less than the full panel sections needed to completely enclose the various components. For example, if six panels are needed to completely enclose the components within the housing, one or more of the six panels can be omitted to leave open sections of the housing 102 for ready access to various components mounted with the housing.

With further reference to FIG. 1, a water supply inlet 106 for introducing water to the tankless water heater 100 is shown located at an end of a tubing 114 for routing the water to a heat exchanger 116 to heat the water. The tubing 114 can be considered a run line for carrying the water between the inlet 106 and an outlet 124 (FIG. 2), as further discussed below. An inlet flow valve 108 can be placed downstream of the inlet 106 to regulate fluid flow into the tankless water heater 100. The valve 108 can be a manually operable control valve or an electronically adjustable control valve. The inlet flow valve 108 may be referred to as a seasonal flow valve as its use can depend on the water supply temperature, which can change from season to season and from one location to the next. In an example, the inlet 106 is part of the inlet to the valve 108 rather than a nipple or an extension extending from the valve 108.

An inlet temperature sensor 110 and a water flow sensor 112, such as a flow meter, can be positioned inline and downstream of the inlet flow valve 108. In some embodiments the relative positions of the inlet temperature sensor 110 and the water flow sensor 112 may be reversed. In other embodiments one or more of the seasonal flow valve 108, inlet temperature sensor 110, and water flow sensor 112 may be omitted from the tankless water heater for RV 100 of the present disclosure. The inlet temperature and flow sensors 110, 112 can be used by the controller of the present disclosure to adjust certain flow parameters through the tankless water heater 100, as further discussed below.

In an example, the tubing 114 extends away from the flow sensor 112 towards the heat exchanger 116 and wraps around the exterior of the heat exchanger 116, which has a plenum or a skirt. The run line or tubing line 114 wraps around the skirt and by conduction is heated by the skirt which then heats the inlet water running in the tubing, similar to a preheat. Because both the skirt 158 and the tubing 114 can be made from a highly conductive material, such as copper or copper alloy, heat energy is transferred by conduction from the skirt 158 to the tubing 114 and from the tubing to the water running therein. As a result, the water entering the tankless heater 100 is pre-heated before entering the heat exchanger 116. The tubing 114 then enters the heat exchanger 116 so as to be heated by the heated gas from the burner 164, as further discussed below.

Within the body 160 of the heat exchanger 116, a plurality of spaced apart fins 162 are provided. The fins 162 can be closely spaced or loosely spaced inside the heat exchanger to form baffles or channels for the flow of heated air from the bottom of the heat exchanger and then rising through the fins and out the top of the heat exchanger, elevation-wise. The number of fins can depend on the desired heat exchange rate by convection, conduction, and radiation exchanging with the interior run line of the tubing 114. The tubing 114 passes through the fins 162 and wherein U-shaped returns are provided to connect the parallel tubing sections in a turpentine fashion within the interior space of the heat exchanger 116. The number of fins and the total tubing length passing inside the heat exchanger can be selected to control the residual time of water travelling through the heat exchanger and the amount of heat transferring directly from the burner 164 to the tubing 114 and from the burner 164 to the fins 162 and then to the tubing 114.

In one embodiment, the tubing 114 and the heat exchanger 116, such as the skirt 158 on the exterior, are made from a highly conductive material, such as copper, brass, or their alloys. In other embodiments, the heat exchanger 116 and the tubing 114 may made be made from other corrosive resistant materials that are able to withstand the direct or indirect heat of the burner.

Figure 2:
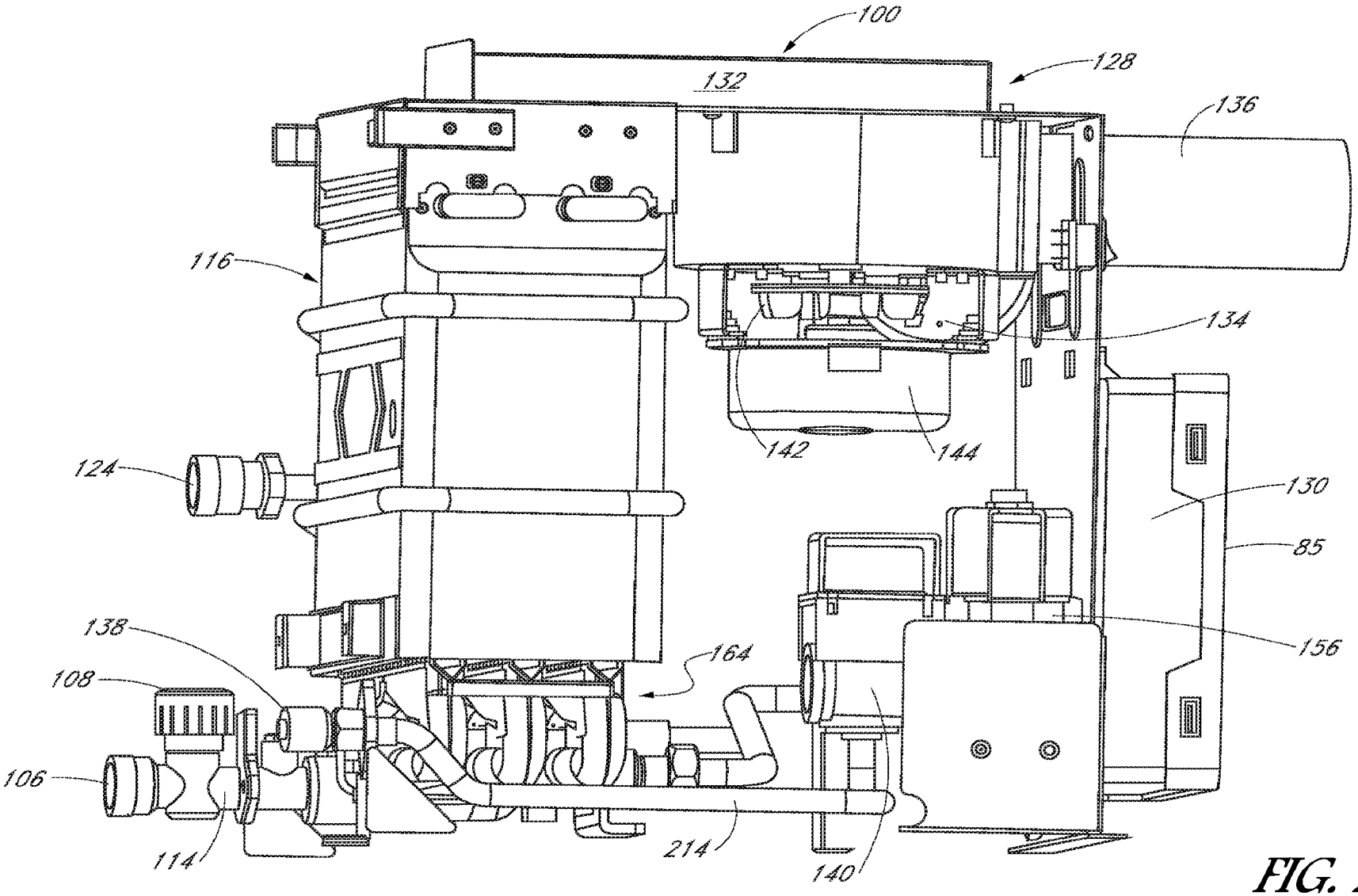
FIG. 2 is a side view of the tankless water heater for RV of FIG. 1.

In some examples, inlet and outlet headers are provided within the heat exchanger 116. For example, the tubing 114 can direct inlet water to the inlet header that then separates the single inlet feed line into multiple parallel run lines inside the heat exchanger. The multiple run lines are then routed to an outlet header that then consolidates the various run lines into a single outlet line, which then exits the heat exchanger 116 and flow into the discharge or outlet line 124 (FIG. 2).

Figure 6:
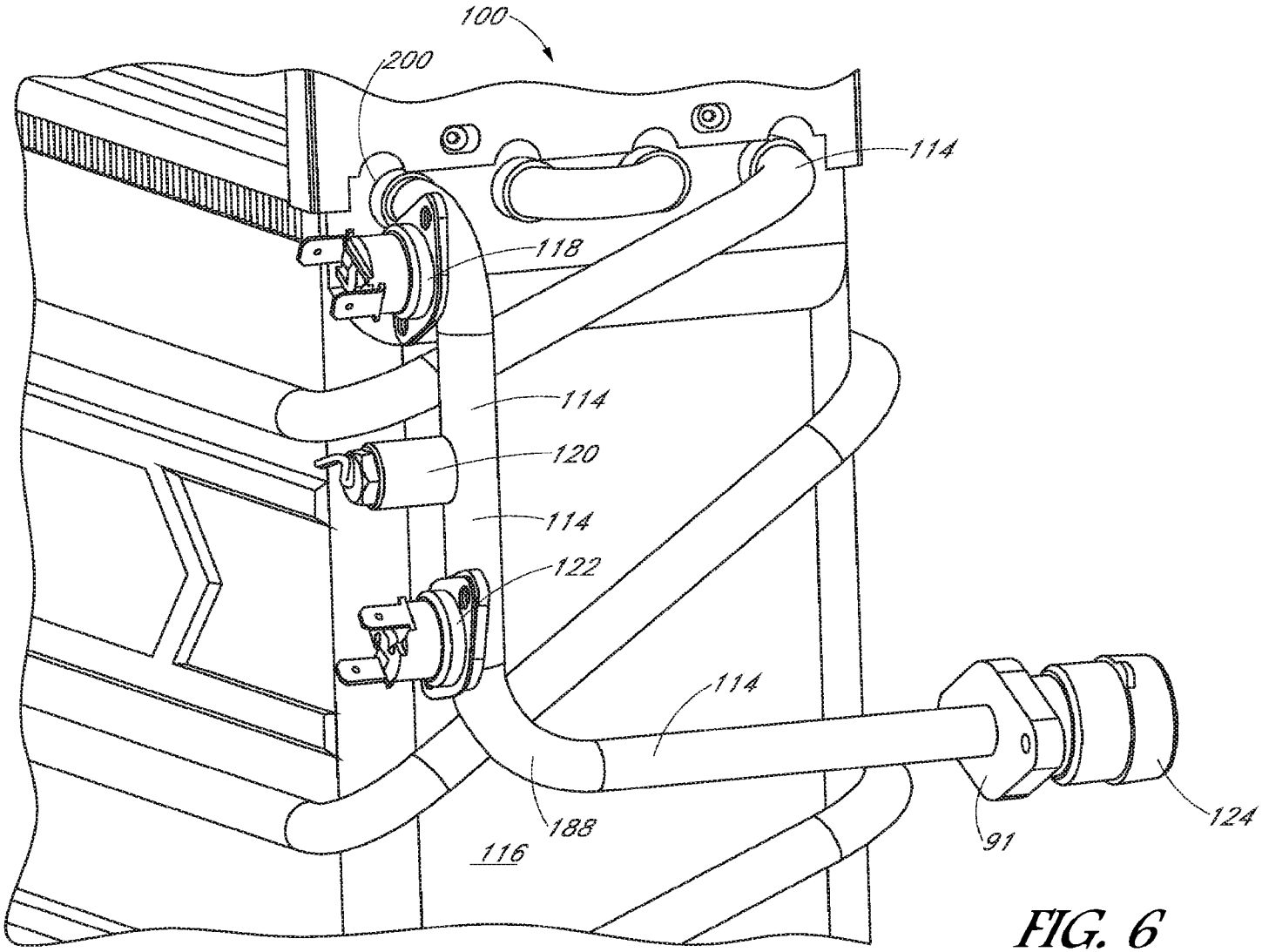
FIG. 6 shows a side close up perspective view the outlet header of the tankless water heater of FIG. 1.

In the embodiment shown, the tubing 114 wraps around the skirt of the heat exchanger twice in the form of loops, such as continuous loops or in sections that are joined. In other embodiments, the tubing may have fewer than two loops wrapping around the skirt 158 of the heat exchanger or more than two loops wrapping around the skirt 158 of the heat exchanger 116. The length of tubing 114 and the number of loops formed or wrapped around the heat exchanger 116 can depend on the residual time desired to route the water through the heater, the number of tie-ins needed to connect the various component, and the desired preheat, among others The tubing run line inside the heat exchanger 116 exits the heat exchanger 116 near point 200, which in the present embodiment is located near an upper side section of the heat exchanger. A temperature switch 118 is connected inline and downstream of point 200. Output from the temperature switch 118 can be used for freeze prevention, as further discussed below. A hot water temperature probe 120 is connected downstream of the freeze prevention switch 118 and an emergency cut-off (ECO) switch 122 is connected downstream of the hot water temperature probe 120 (FIG. 6). The tubing 114 terminates with an outlet 124, which is positioned above the inlet 106, elevation-wise. In some examples, the inlet 106 is located above the outlet 124, elevation-wise. The inlet and the outlet can alternatively be mounted side-by-side, approximately at the same elevation. In still other examples, additional probes and/or sensors can be connected in-line with the tubing 114 for sensing and controlling or regulating other flow functions. The various connections can be threaded, welded, by mating flanges, or combinations thereof. In some examples, a threaded bore is provided on a side of a fitting, such as a threaded socket or a threaded thermowell, for receiving a probe, which can include a thermostat, a flow sensor, or other sensing devices. Optionally, welding may be used to connect the various components and tubing sections.

In some embodiments, the order of the freeze prevention switch 118, the hot water temperature probe 120, and the emergency cut-off switch 122 described hereinabove with reference to FIGS. 1 and 2 may be rearranged in different sequence given that all of the components are mounted in-line and between the heat exchanger 116 and the outlet 124. Thus, the ECO switch can be located immediately downstream of the heat exchanger, then the outlet temperature probe, then the freeze prevention switch downstream of the outlet temperature probe. In still other embodiments, one or more of the freeze prevention switch 118, the hot water temperature probe 120, and the emergency cut-off switch 122 may be omitted from the tankless water heater for RV 100 and the water heater used in very basic mode or in manual mode. When used, the freeze prevention switch and the ECO switch are similar but have different set points. The freeze prevention switch is configured to switch or output a signal when the temperature reaches a low temperature set point so that the microprocessor can initiate the burner. In contrast, the ECO switch is configured to switch or output a signal when the temperature reaches a high temperature set point so that the microprocessor can shut off the inlet gas flow.

The burner 164 is positioned immediately adjacent the heat exchanger 116 and provides the heating source to heat the exchanger 116. In an example, the burner 164 is positioned below the heat exchanger 116, elevation-wise, so that hot air generated from the burner rises through the heat exchanger. In an example, the burner 164 can have a wide tip having multiple gas discharge holes to provide a large distributed flame profile. The tip can comprise a plurality of plate-like structures positioned side-by-side with each plate having a plurality of discharge holes formed on an edge thereof for gas flow. The tip can alternatively have a circular ring shape, a rectangular shape, an elliptical shape, a square shape, or other shaped tips provided the number of discharge holes are selected to produce sufficient BTU for a given gas type and gas pressure.

An exhaust system 128 comprising an exhaust collector 132, an air pressure switch 134, and a vent duct 136 can be provided to direct exhaust fumes created by the burner 164 away from the housing 102. Additional ducting may be provided to direct the exhaust gas through the vent duct 136 and out, such as out an opening to an exterior of the mobile or recreational vehicle. In some examples, an induced draft fan, a force draft fan, or both can be incorporated to move gas through the tankless heater 100. As shown, the tankless hot water heater 100 has an induced draft fan for drawing exhaust gas away from the heater. The air pressure switch 134 can be positioned to sense air or gas flowing through the exhaust system. If the pressure from the switch produces a low flow signal, the microprocessor can interpret the data as insufficient air flow and can shut off the gas flow to the heater.

Various functions of the tankless water heater 100, such as set temperature, flow rate, and flow for freeze prevention, may be controlled using a controller 202 having a microprocessor 130. The microprocessor 130 in the controller 202 acts as a gateway for receiving signals and data from the various sensors and is programmed to control operation of various components of the tankless water heater for RV 100 based on the received signals and data, as further discussed below. For example, based on the temperature data received from one of the thermostats or probes, the microprocessor 130 can send control signals to a gas regulator to modulate gas flow feeding the burner 164, as further discussed below.

As shown, the water supply inlet 106 can have a standard fitting to readily accept a water feed line or inlet water source. For example, the inlet 106 can comprise an industry standard connection fitting for attaching to a water supply or cold water supply line. The hot water outlet 124 similarly can comprise an industry standard connection fitting for attaching to plumbing lines that then carry heated water to user stations, such as to sinks and baths/showers located elsewhere in the vehicle on which the tankless water heater for RV is mounted.

The seasonal flow valve 108 can be manually adjusted by a user to either reduce or increase the volume flow rate of the incoming water supply through the tankless water heater 100. As explained in more detail below, this allows the tankless water heater for RV 100 of the present disclosure to operate with an incoming water supply having a temperature falling within a relatively wide range without requiring an increase in heat output from the burner 164 of the tankless water heater for RV 100 to still provide efficient heating.

In other embodiments, the seasonal flow valve 108 may be automatically controlled by the controller 202 based on various input data and signals from, for example, the flow valve 112, the input water temperature sensor 110, and the output water temperature sensor 120. For example, the flow valve 108 can be connected to a solenoid and controlled by the controller 202, which can open or close the flow valve 108 depending on the temperature of the water entering the inlet 106 and/or the set temperature of the water at the outlet 124. A control element, knob, or adjustment element on the seasonal flow valve 108 may be turned one direction to restrict the incoming flow volume and the opposite direction to increase the incoming flow volume. In other examples, a valve stem of the flow valve 108 can simply translate along an axis of the valve stem rather than rotate to control flow through the valve 108, such as when actuated by a motor or a solenoid. Other embodiments of the tankless water heater for RV 100 can exclude the seasonal flow valve.

If incoming water temperatures are within a range of approximately 50 degrees Fahrenheit ("F") to about 80 degrees Fahrenheit, such as during cooler seasonable periods, the tankless water heater 100 may operate without any adjustment to the seasonal flow valve 108. In the water inlet temperature range of about 50 degrees F. to about 80 degrees F., the controller 202 can control other parameters of the heat exchanger 116 to produce water at user-specified temperatures of up to about 120 degrees Fahrenheit without having to manipulate the seasonable flow control valve 108, as will be described in further detail below. When the inlet water temperature falls outside of this range, the seasonable flow control valve 108 can be manipulated, such as turned or actuated to further open or close, so that the water temperature at the outlet 124 can reach up to about 120 degrees F. In other examples, the portable heat exchanger can be sized to yield the desired hot water temperature output for a different water range without having to adjust the seasonable flow control valve. The range of about 50 degrees Fahrenheit ("F") to about 80 degrees Fahrenheit therefore represents an exemplary range only that can be sized before resorting to any adjustment to the seasonal flow valve 108.

Outside of the approximate 50-80 degree Fahrenheit temperature range, the seasonal flow control valve 108 may be used, such as turned or actuated to further open or close, to effectively extend the range of incoming water temperatures useable with the tankless water heater for RV 100 without requiring the burner 164 to yield additional heat capacity or requiring over-sizing the burner during initial assembly but operating the burner in a normally throttled state. When the incoming water supply is less than 50 degrees Fahrenheit, such as during the winter season, the inlet water flow rate may be restricted by the seasonable flow control valve 108 so that there is less water moving through the heat exchanger 116 at any given time. With a reduced volume of water flow rate to heat, the heat exchanger 116 can apply the same amount of energy to the reduced water flow rate as compared to a larger water flow rate but at a higher inlet temperature, such as during the summer season.

By reducing the inlet flow rate when the water temperature drops, this reduces the mass to be heated by the burner to raise the water temperature over a larger temperature delta, such as for a lower starting temperature due to the cooler season to the same set temperature of 120 degrees F., as an example, and allows the tankless water heater of the present disclosure to operate with the same burner and rated BTU output in varied environments normally not experienced with residential mounted tankless water heaters. In other words, the present tankless water heater 100 of the present disclosure can raise water temperature over a greater temperature differential or delta T between the inlet and the outlet by reducing the inlet volume flow rate to allow the tankless water heater for RV 100 to achieve the desired output temperature by the user even when incoming water supplies has a temperature below 50 degrees Fahrenheit.

The converse may be true of incoming water supplies with temperatures greater than 80 degrees Fahrenheit. The flow volume may be increased at the seasonal flow control 108 so that a greater flow volume of incoming water can flow through the heat exchanger 116. Applying energy to an increased volume of water will result in a lower water temperature differential or delta T at the outlet but still acceptable if the inlet temperature is on the high side. This arrangement allows for water temperature control to be based at least in part on water volume rather than controlling temperature differential based on BTU output at the burner. In some examples, temperature control of the water outlet can be based on both, such as based on regulating the inlet volume flow rate of the inlet water and the amount of BTU fired at the burner.

Unlike a tankless water heater installed in a permanent structure, such as in a home which has a generally stable water supply temperature and pressure, a recreational vehicle with a tankless water heater moves from water supply source to water supply source when on the road travelling from point A to point B. The tankless water heater for RV 100 should be able to produce water at the desired temperature from widely varying water supply temperatures while still maintaining a relatively small size or profile to fit within the portable environment of the recreational vehicle. The ability to control the volume of water entering the tankless water heater for RV allows the tankless water heater for RV to operate over a greater range of water supply temperatures without requiring the production of additional heat energy, which would require a larger burner and possibly a corresponding larger fuel supply source and larger housing to accommodate.

As shown in FIG. 1 and further discussed below, the water supply inlet 106, the seasonal flow valve 108, and the hot water outlet 124 can be located externally of the housing panels 104, such as externally of the front panel 104*b*, of the housing 102 for quick access by a user. Optionally, the tubing 114 and the vent 136 can be located, at least in part, outside of the panels of the housing to facilitate assembly and maintenance, among other things.

FIG. 2 shows a side view of the tankless water heater for RV 100 of FIG. 1. This view of the tankless water heater 100 is shown without any housing panels 104 to more clearly depict the parts or components mounted therewith or therein. More clearly shown are the water supply inlet 106 and the seasonal flow valve 108, which are in line with each other and connected with the tubing 114. Both the water supply inlet 106 and the seasonal flow valve 108 may be located near the bottom of the tankless water heater for RV 100 and externally of the front panel 104*b*.

The heat exchanger 116 and associated parts are also clearly shown in FIG. 2. The gas inlet 138 is shown spaced laterally from the water inlet 106. The gas tubing 214 connects the gas inlet 138 to a linear valve 140 and the linear valve is connected in line to a solenoid valve 156 and the burner 164. In an example, a linear valve 140 provided by CAE, model number CPV-H2467AY, can be used to control gas flow through the tankless water heater 100. Other linear or equal percentage valves are contemplated for use with the present system to regulate gas flow through the tankless water heater based on various sensed parameters, such as water flow, inlet and/or outlet water temperatures. The linear valve 140 and solenoid valve 156 are connected to the microprocessor 130 of the controller 202, which is programmed to control the linear valve and the solenoid valve based on data and signals received from sensors. In general, the solenoid valve 156 is an on/off valve only while the linear valve 140 can be and on/off valve and can be regulated to control gas flow from full flow to fully shutoff, as described in more detail below. Together, the solenoid valve and the linear valve can act as a dual emergency shut off valve when both are in the off position. The tankless water heater may accept propane gas only, such as while travelling with propane tanks or when parked at a camp site.

The exhaust system 128 is also shown in more detail in FIG. 2. The exhaust collector 132 of the exhaust system is positioned at the top of the housing unit to collect fumes rising from the burner 164. Fan blades 142 powered by a motor 144 located below the fan directs fumes through the vent 136 where the fumes exit the tankless water heater for RV 100. The vent 136 extends, at least in part, outside of the housing. The fan motor 144 is connected to the microprocessor 130 of the controller, which is configured to operate the motor to turn the fan on and off based on signals sent to the microprocessor 130 from the one or more sensors.

The water supply inlet 106, hot water outlet 124, and seasonal flow valve 108 are shown extending away from the front panel of the tankless water heater 100. As shown in FIG. 1, these parts may be located exterior to the housing. In an example, both the inlet and outlet nozzles point in in the same direction.

The vent or vent duct 136, which can shape as a hollow cylinder, also extends away from the housing of the tankless water heater for RV. In an example, the vent duct 136 has an end opening that points in the opposite direction to the water inlet. As shown, a controller housing 85 with a removable cover and the microprocessor 130 located therein are located on the same side as the vent duct 136, such as below the vent duct. In some embodiments, the cover of the controller housing 85 is flushed with the panels 104 of the heater housing 102.

Figure 3:
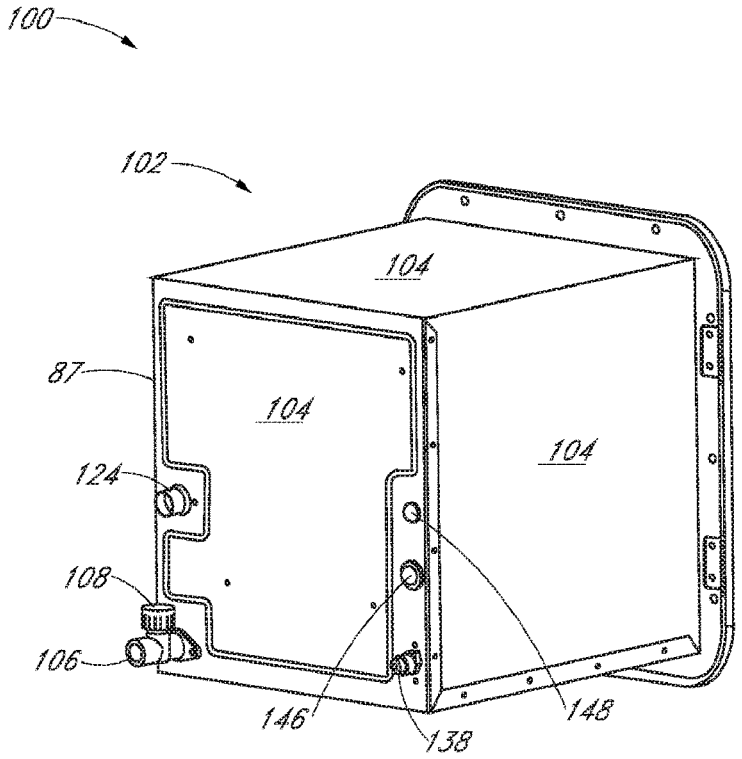
FIG. 3 shows a perspective view of the tankless water heater for RV of FIG. 1 with housing panels in place.

FIG. 3 shows the tankless water heater for RV 100 in a perspective view. In FIG. 3, the tankless water heater for RV is shown with all the panels 104 installed to the frame 87 of the housing 102. Some of the external connections and components of the tankless water heater for RV 100 can be seen. The water supply inlet 106 and seasonal flow valve 108 are shown connected in line on the bottom left of the front panel. In some examples, such as shown, the inlet 106 and the valve 108 are located with the housing frame 87 and the front panel 104*b* is removable from the frame 87. Above the water supply inlet 106 is the hot water outlet 124. On the bottom right side of the frame 87 is the gas inlet 138. Above the gas inlet is a DC connector port 146 for powering the tankless water heater for RV 100. In an example, the DC connector port 146 is a passage or bore through the housing having a plastic ferrule that allows one or more cables to pass therethrough for connections between the electric system of the water heater, such as the controller, and the vehicle's electric system.

The controller and microprocessor of the present tankless water heater 100 can take different voltages, such as 12 Volt DC to 24 Volt DC. Generally, 12 Volt DC is produced by the on-board power system of a recreational vehicle to power various auxiliary devices. The power can be tied or linked to the ignition system or supplied from a battery bank with fulltime power, as is well known in the RV industry. The battery bank that supplies fulltime power can be charged by the vehicle's generator or by plug-in AC power when the RV is plugged into an AC source. Above the DC connector 146 is an I/O connector port 148 that can be used to set control parameters for the controller. Like the DC connector port 146, the I/O connector port 148 can be a passage or bore through the housing having a plastic ferrule that allows one or more cables to pass therethrough for connections between the electric system of the water heater, such as the microprocessor, and a control panel 170 (FIG. 4), which can be mounted remotely from the tankless water heater, such as near the kitchen or the vehicle dashboard.

Figure 4:
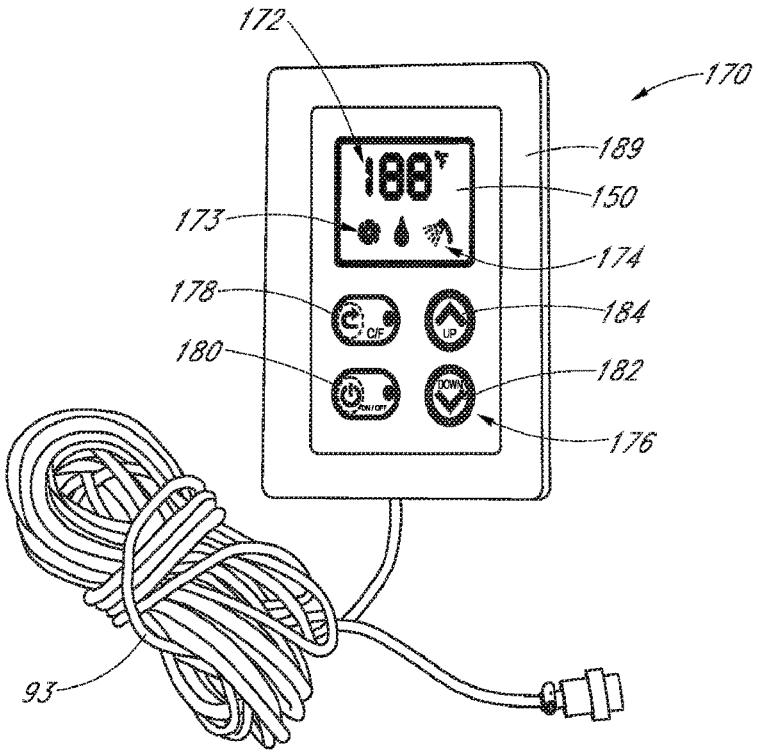
FIG. 4 shows a front view of a control panel of the present disclosure usable with the tankless water heater of FIG. 1.

An exemplary control panel 170 is shown in FIG. 4. The control panel 170 comprises a housing 189 comprising a display 150 and connection cable 93 to connect the control panel 170 through the I/O port 148 and to the controller. The display 150 can be an LCD, an LED, or any commercially available display type and can include fields or areas 172 for displaying different information. The housing 189 of the control panel 170 is sized and shaped to be handheld or can be mounted on a surface or a panel.

In one embodiment, one area 172 of the display 150 may provide information regarding the temperature of water exiting the hot water heater 100. The hot water temperature probe 110 can provide this data to the microprocessor 130, which is then picked up and displayed by the control panel 170 when the control panel is plugged into the connector port 148 on the frame 87 of the housing.

Another area 173 of the display 150 may include icon graphics. In an exemplary embodiment, a plurality of icons 174 can be included to display operating parameters, states, or conditions of the various components of the tankless water heater, such as to indicate whether the fan 142 (FIG. 2) is operating, whether the igniter on the burner 164 is operating, and/or to indicate that water is flowing through the water heater 100, among other information and icons. The display 150 is sized and shaped to be readily and easily visible to a user. A dimmer switch can be included to change to light output of the display.

The microprocessor of the controller can be programmed to diagnose problems and store the information in a local memory drive as error codes. The control panel 170 can display the error codes that can then be used by a technical service personnel to troubleshoot the tankless water heater for RV 100. In one embodiment, the microprocessor 130 is programmed to track a plurality of different error codes, such as five or more codes. The codes can be numbered consecutively from a zero to N in increment of one. If the display has limited fields and the error code is limited to a single digit, then a number, such as "n," may be used, which can represent 10, as an example.

If a failure were to occur in the tankless water heater 100 of the present disclosure, the microprocessor can detect the error and the specific cause can be indicated by the error on the Display to display one of the following exemplary causes and codes.

| Error Code | Error Type/Symptoms |
|---|---|
| E0: | Water Outlet Temperature Probe failure.<br>An open circuit or short circuit condition is detected:<br>This could be due to an internal failure in the Temperature Probe or to a faulty connection (Wires) |
| E1: | Ignition failure or accidental flame off during ignition.<br>If the established flame signal is lost while the burner is operating, the control will respond within 0.8 seconds, the gas valve is de-energized and a new inter-purge and ignition routine will begin. If the burner does not light, the control will de-energize the gas valve and will make two more attempts to relight the burner. If the burner does not relight after the three trials the control will go into LOCKOUT and the unit will need to be turned off before it can operate again. This could occur for a number of reasons.<br>The most common are:<br>Lack of Gas in the tank<br>Faulty Igniter<br>Faulty Igniter connections<br>Improper distance between the Igniter and the Burner<br>Accumulated dirt or obstruction between Igniter and Burner<br>Low Gas Inlet pressure |
| E2: | Flame sensing interrupted during normal operation.<br>Buzzer will sound.<br>Possible causes are the same as indicated by Error E1 if any of these conditions occur during normal operation. A lock out will occur also in these conditions. |
| E3: | ECO open before ignition or during normal operation.<br>This occurs if the ECO thermostat opens. Under normal circumstances this is due to the Temperature of the water at the Outlet exceeds 175 F. The cause must be identified and removed before restarting the unit. |
| E4: | Water Inlet Temperature Probe failure.<br>An open circuit or short circuit condition is detected:<br>This could be due to an internal failure in the Temperature Probe or to a faulty connection (Wires) |
| E5: | Blower motor failure.<br>No motor signal was detected before ignition or during normal operation. This could be also caused by a wiring fault in the motor connections. |
| E6: | Over-temperature.<br>Outlet Water Temperature has exceeded 140° F. (60° C.) for 3 sec. |
| E7: | Linear valve failure:<br>The Controller Module detects an open circuit in the Linear Valve control circuit before ignition or during normal operation indicating a faulty Valve. |
| E8: | Air pressure switch:<br>Air pressure switch not detected for 7 sec. before ignition or is cut-off for 2 sec. during normal operation. This failure may be caused by a faulty motor or a blockage in the air supply or in the exhaust system. |
| E9: | Flame sensor:<br>Flame is sensed before ignition. Buzzer will sound. This is displayed when a short is detected in the flame sensor. |
| En: | System Timer:<br>Water Heater ran longer than 30 min. |

The control panel 170 may also include plurality adjustable switches in the form of buttons 176. The buttons 176 may be arranged anywhere on the housing 89 of the control panel and usable by a user to control operating parameters of the tankless hot water heater for RV 100. In one embodiment, the buttons 176 are placed on the same side as the display 150. In other embodiments, the buttons may be placed on sides that are different than the side with the display. For example, the control panel 170 can include a first button 178 for changing the temperature display between Celsius and Fahrenheit. The control panel 170 may also include a power button 180 for powering the tankless water heater for RV on and off. The control panel 170 can further include second and third buttons 182, 184 for changing or setting the output temperature of the hot water.

The buttons 176 can be of the permanent or hard button type and can have graphics printed on them to inform the user of parameter or information that they control or can be of the soft type that can vary depending on the screen. The buttons 182, 184 for controlling the water output temperature can have an up arrow or a down arrow graphic.

Further, light emitting diodes (LED) or other light producing devices may be associated with the buttons 176 to indicate that a particular button 178, 180, 182, or 184 is operating or that the function associated with the particular button 178, 180, 182, or 184 is active. For example, an LED may stay lit once the power button 180 has been pressed, and the tankless water heater for RV 100 (FIG. 1) remains powered on. The buttons 176 may be of the same size or may be of a different size relative to one another.

In an exemplary embodiment, the controller 202 and microprocessor 130 of the tankless water heater are connected to the onboard fulltime DC power supply 152 (FIG. 8) of the recreational vehicle and not dependent on the car ignition system. By connecting to the vehicle's fulltime power, the controller is always powered and various set points using the control panel 170 and various parameters and data used by the microprocessor are maintained or saved. In other examples, the controller is equipped with auxiliary memory that stores set points and parameters and can retain the information even when power is disconnected to the controller. When auxiliary memory is incorporated, the controller can be supplied with vehicle's generator power.

Figure 5:
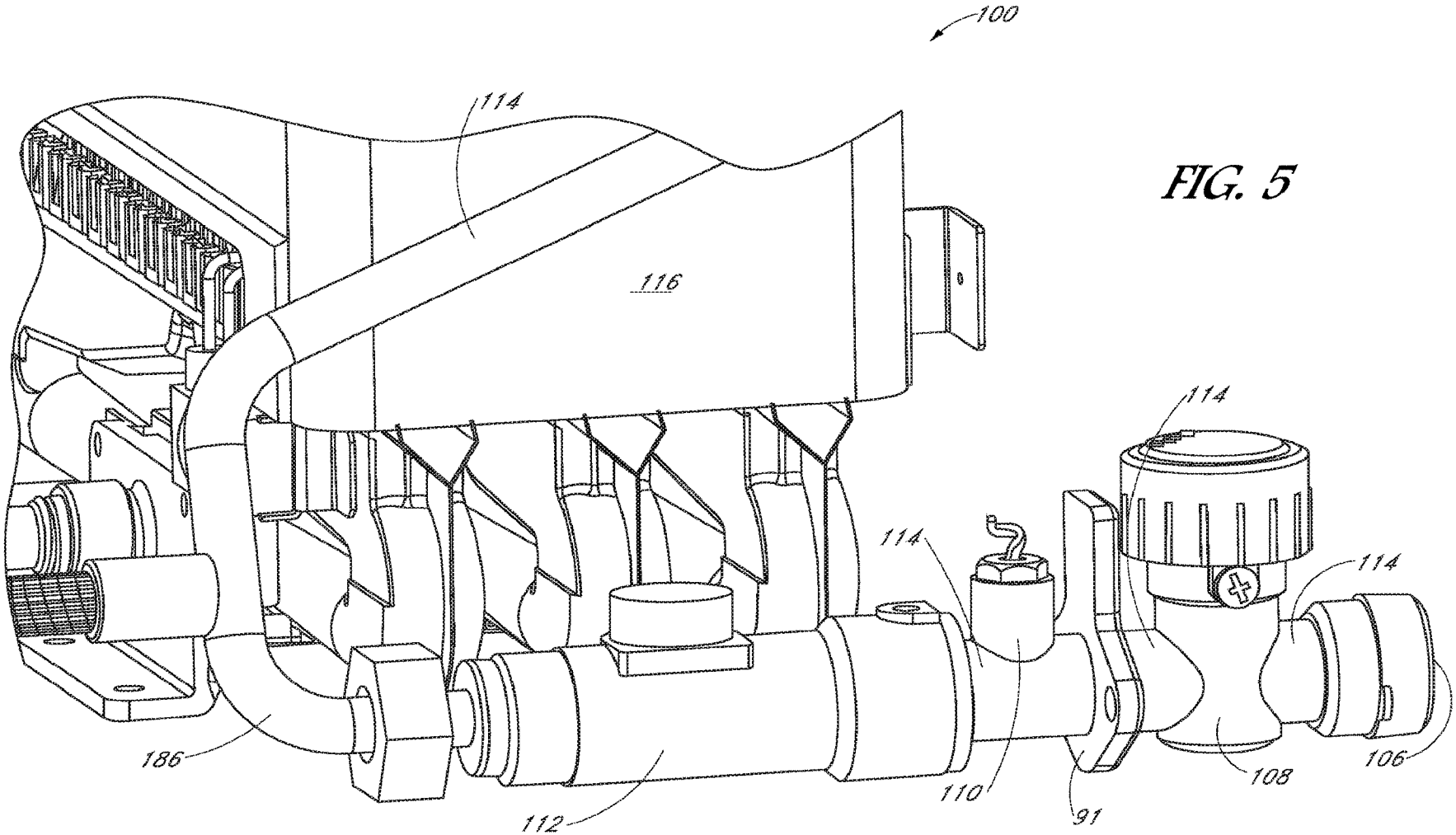
FIG. 5 shows a side close up perspective view the inlet header of the tankless water heater of FIG. 1.

FIG. 5 shows a detail view of the tubing 114, the inlet valve 108, and sensors 110, 112 of the tankless water heater for RV 100 positioned upstream of the heat exchanger 116. The water supply inlet 106 can include a quick connect coupling or a threaded collar. The seasonal flow valve 108 can comprise a manually tunable ball valve, gate valve, or glove valve with a rotatable knob. The inlet 106 can be the valve 108 inlet, such as being part of the valve body of the valve 108. A support flange 91 having two or more holes for use with screws may be provided in line with the tubing to secure against the frame 87 of the housing and support the tubing 114 and the various components. The inlet temperature sensor 110 is shown as a thermocouple threaded to a female thermowell. The flow sensor 112 downstream of the inlet temperature sensor 110 can embody any number of types, such as a differential pressure flowmeter, a velocity flowmeter, or a mass flow meter type. As shown, the flow sensor 112 is an Aiber 2 mPa-5/12 VDC type. A bend 186 redirects the tubing upwards toward the top of the tankless water heater for RV to connect to the heat exchanger 116.

FIG. 6 shows a detail view of the tubing 114 and sensors 118, 120, 122 of the tankless water heater for RV 100 positioned in line after the heat exchanger 116, which are downstream of the components discussed above with reference to FIG. 5. The tubing 114 exits the heat exchanger 116 and has a freeze prevention switch 118 connected in-line therewith, which is configured to initiate a reaction in the microprocessor when activated at a certain set point to prevent freezing. A hot water temperature probe 120 and an emergency cut-off switch 122 are connected in-line and downstream of the freeze prevention switch 118. A right angle bend 188 changes the direction of the tubing 114 and the tubing terminates with at hot water outlet 124. A support flange 91 is provided adjacent the water outlet 124 for connecting to the frame of the housing and supporting the tubing and the various components. In some embodiments, the hot water outlet 124 may terminate externally of the front panel of the housing while in other embodiments, the hot water outlet 124 may be flushed with the front housing panel.

In some embodiments, the tankless water heater for RV may omit one or more of the freeze prevention switch 118, hot water temperature probe 120, and the emergency cut-off switch 122.

Figure 7:
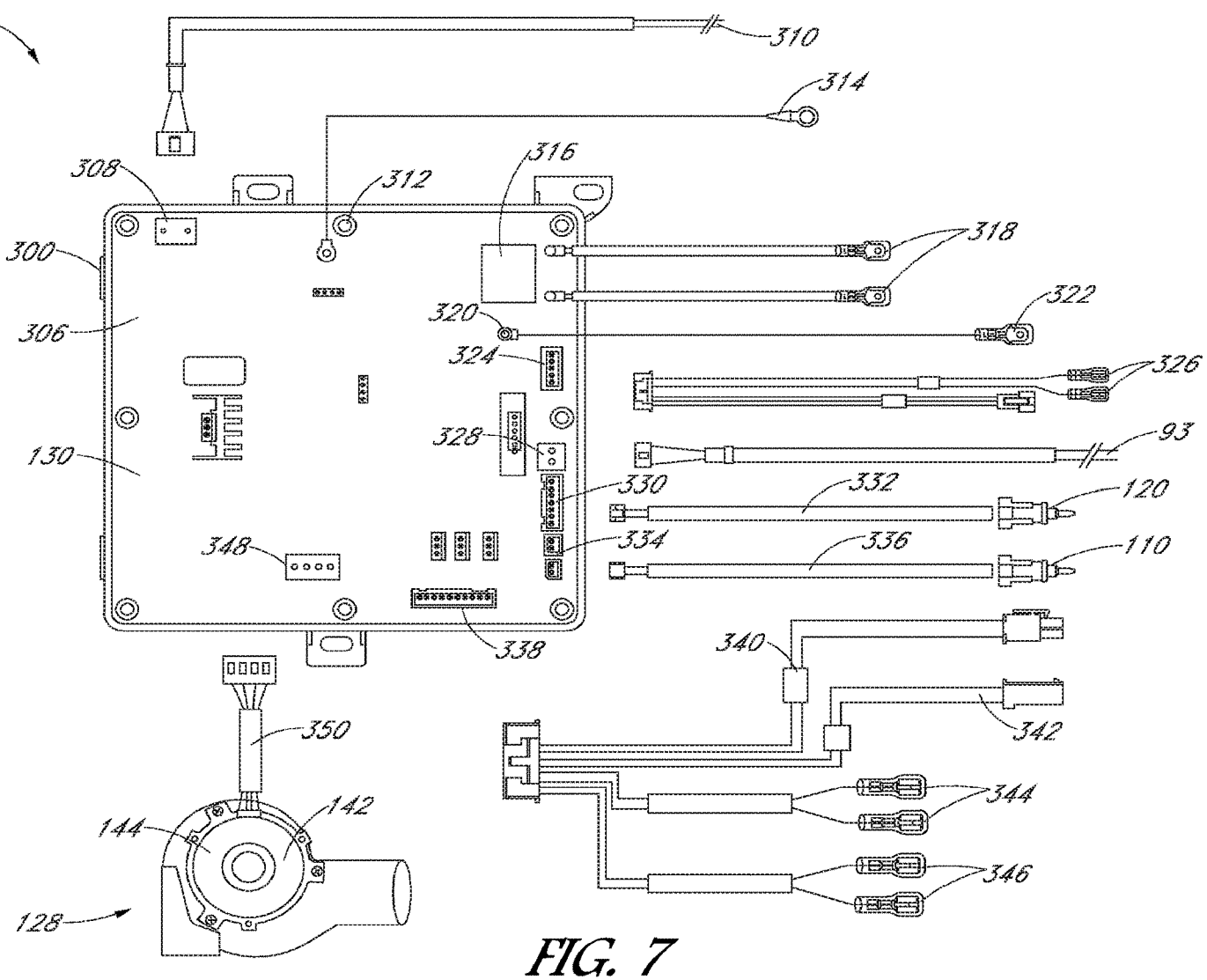
FIG. 7 shows a schematic diagram of a controller having a microprocessor and connections therewith.
Figure 7A:
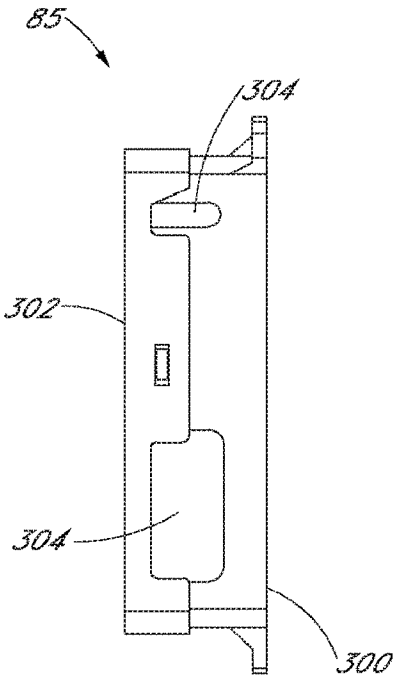
FIG. 7A is a side view of a controller housing for housing the microprocessor.

FIG. 7 shows parts of the controller 202 and FIG. 7A shows the controller housing 85. With initial reference to FIG. 7A, the controller housing has a base 300 and a cap or cover 302 attached to the base through conventional means. The base 300 has flanges for attaching the controller housing to the water heater housing. A plurality openings or ports 304 of similar or different sizes are provided in the housing 85 to terminate various cables and wires, as further discussed below.

FIG. 7A shows a top view of the controller 202 with the cover 302 removed from the base 300 to expose the PCB 306. As shown, a power terminal 308 is providing for connecting a power cable 310 between the power terminal 308 and a DC power supply source, preferably the fulltime battery power supply source. The PCB 306 has a grounding terminal 312 for use with a grounding cable 314 to ground the circuit.

An ignition terminal 316 is provided for the ignitor high voltage wires 318, which supply the necessary power to two ignition sparks located at the ends thereof to supply the ignition source for the burner 164. The flame feedback terminal 320 is located adjacent the ignition terminal 316 and is provided for use with a furnace for flame sensor connected to the flame feedback wire 322.

The air pressure switch 134 can be connected using a wind and pressure switch wire 326 to the air pressure terminal 324. The remote control 170 can be connected to the I/O port 328 of the PCB 306 via the remote connection cable 93. The outlet temperature probe 120 can connect to the outlet temperature terminal 330 via the outlet temperature cable 332 and the inlet temperature probe 110 can connect to the inlet temperature terminal 334 via the inlet temperature cable 336.

A multi-pin connection terminal 338 is provided on the PCB 306 to connect to the solenoid valve 156 via cable 340 and the linear valve 140 via cable 342. The ECO switch 122 and the freeze prevention switch 118 can connect to the multi-pin connection terminal 338 via cable 344 and cable 346, respectively.

The fan assembly or exhaust system 128 comprising fan blades 142 and a motor 144 for rotating the fan blades 142 can be connected to the power and control terminal 348 on the PCB via a fan system cable 350. The power and control terminal 348 are configured to supply DC power to the motor 144 and to terminal power pursuant to the control supervision of the microcontroller 130.

Figure 8:
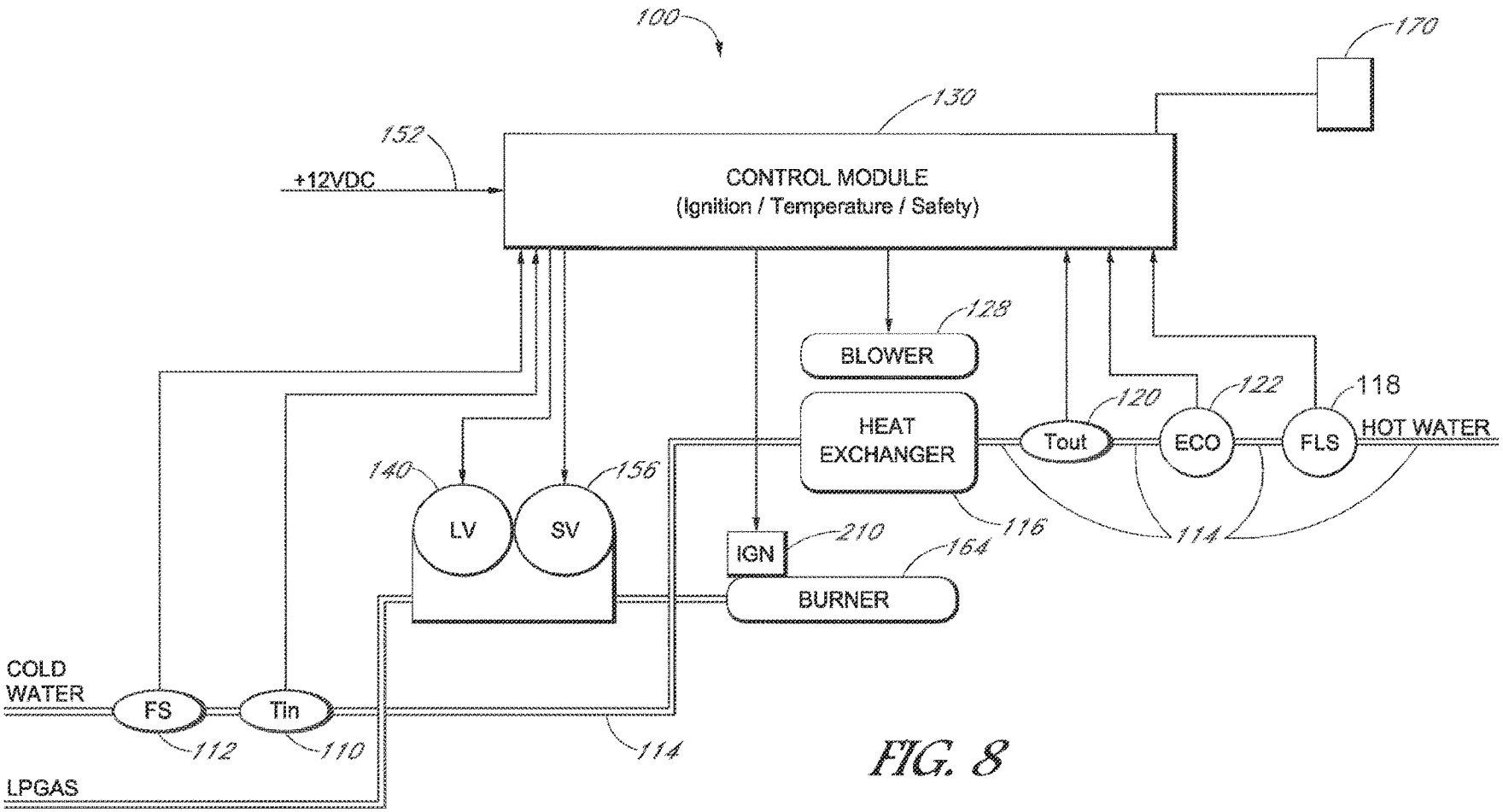
FIG. 8 shows a schematic diagram of the tankless water heater.

FIG. 8 shows a schematic diagram of the tankless water heater for RV 100 of the present disclosure, which illustrates the flow of water and gas through the system. FIG. 8 further illustrates the connection between the electro-mechanical parts or sensors and the microprocessor 130, similar to the connections shown in FIG. 7.

With reference to FIGS. 7 and 8, a user may connect a control panel 170 to the tankless water heater for RV 100 via a wire or cable connection, placing the control panel in electrical communication with the microprocessor 130. In other embodiments, the control panel may 130 be connected wirelessly to the microprocessor or is integrated with the housing. As described above, the microprocessor 130 is programmed to receive signals from the inlet temperature sensor 110, which detects the temperature of the water inlet. The microprocessor 130 can provide the control panel 170 with the temperature information to display temperature on the display screen of the control panel 170.

Based on the temperature of the water displayed on the control panel 170, a user may wish to set or adjust the temperature of the outlet water. Using the buttons 176 (FIG. 4) on the control panel 170, the user can adjust the temperature set point, such as to 115 degrees F., which is then sent to the microprocessor 130.

The microprocessor 130 receives the temperature set point from the buttons 176 (FIG. 4) on the control panel 170 and based on the set point and other input from other sources, such as the inlet temperature and the flow rate through the system, the microprocessor uses an algorithm programmed for the particular linear valve 140 and downloaded to the microprocessor 130 to calculate control points or parameters. For example, the results of the algorithm are used by the microprocessor 130 to operate the tankless water heater for RV to achieve the water output selected by the user. In an example, the microprocessor 130 uses the results of the algorithm to operate the linear valve 140, such as to modulate the gas flow rate through the linear valve, to control the heat energy output of the burner 164, which directly effects how much heat is imparted to the water flowing through the tubing 114 and through the heat exchanger 116. In some embodiments, the microprocessor 130, in implementing the results of the algorithm, can control the seasonal flow valve 108 at the inlet, which can be connected to a solenoid and the microprocessor can control the movement of the solenoid to control flow through the seasonal flow valve 108.

In an example, the microprocessor 130 uses an algorithm based on input from a plurality of factors to produce results that are then used to control the linear valve 140. Optionally, the results can be used to control various other components of the tankless water heater for RV 100 in order to achieve the desired output temperature, such as to modulate other solenoid valves or flow valves to control the water flow rate through the tankless water heater.

One input that can be used by the algorithm, as described above, is the temperature reading of the incoming water supply. The microprocessor 130 can receive this information from the inlet temperature sensor 110, which reads the water temperature of the inlet water flowing across the inlet temperature sensor 110.

Another input that can be used by the algorithm is the volumetric flow rate of water running through the tankless water heater for RV 100. The flow volume can be sensed by the flow sensor 112 upstream of the heat exchanger and the information can be sent to the microprocessor 130 to compute the output set point for the linear valve 140, which can control the gas flow rate feeding the burner 164, as further discussed below.

Another input that can be used by the algorithm running in the microprocessor is the outlet water temperature as sensed by the outlet temperature sensor 120. The microprocessor 130 can receive this information from the outlet temperature sensor 120, which reads the water temperature of the water flowing out of the heat exchanger 116.

Another input that can be used by the algorithm is the volumetric flow rate of the gas supplied to the burner 164. The volumetric flow rate of the gas feeding the burner 164 can be controlled by the linear valve 140. In some embodiments, the microprocessor 130 may use fewer or more factors than three to control the temperature of the water output from the tankless water heater for RV 100.

Once a user sets the portable tankless water 100 heater to a desired water output temperature using the control panel 170, the user may operate a sink or a shower in the recreational vehicle to start the flow of water through the tankless water heater and out the faucet or shower head. By opening a valve to draw water out the tankless water heater, the user starts the water flow through the water heater.

In the tankless water heater for RV 100 of the present disclosure, the flow sensor 112 senses the flow of water and sends a signal to the microprocessor 130 to indicate water flow. The microprocessor 130 can output a signal to the control panel 170 to display a faucet icon, indicating that water is flowing through the tankless water heater for RV. The water inlet temperature and/or the outlet water temperature can also be shown on the display of the control panel 170. Depending on the severity of a potential leak in the vehicle water flow system, it might be possible for a user to detect the leak using reading from the flow sensor 112 to show water flowing through the tankless water heater for RV 100.

Based on the user outlet temperature set point on the control panel 170, the microprocessor 130 can send signals to the linear valve 140 to fully open, fully close, or modulate the linear valve to change the fuel gas volume throughput through the tankless water heater 100, such as through the burner 164. If the water heater is not previously on or in service, the microprocessor 130 can send a signal to an ignitor 210 (FIG. 1) to generate a spark or ignition source. Feedback from the ignitor and/or the burner can be provided by a flame sensor through the flame feedback wire 322 and to the flame sensor terminal 320 on the microprocessor. The flame sensor can confirm that the ignitor 210 has lit the gas and produced a flame on the burner 164. The flame sensor can be located adjacent or near the ignitor 210 and the burner 164. The microprocessor 130 can inform the user that the burner flame is lit by providing an output to the control panel 170 to display a flame icon.

Once the microprocessor 130 has received a signal that the ignitor 210 has successfully ignited the burner 164, the microprocessor 130 can send a signal to turn off the ignitor 210 or the ignitor can timeout after a short programmable period.

The microprocessor 130 can control the exhaust system 128 to ensure that exhaust gas is properly directed out the exhaust duct. In an example, the fan motor 144 (FIG. 2) is energized to rotate the fan blades 142 (FIG. 2) to direct exhaust fumes created by the burner 164 out through the vent. The combination motor and fan blades act as an induced fan to draw exhaust gas out the system, and out through the vent.

The microprocessor 130 can also send a signal to the control panel 170 to display an icon of a fan to indicate that power is flowing to the fan motor, and, by extension, that the fan is running and moving the fumes created by the burner 164.

Based on readings from the flow sensor 112, the inlet temperature sensor 110, and the outlet temperature sensor 120, the microprocessor 130 can determine if any adjustment to the linear valve 140 may be needed to change the gas input to the burner to obtain the output temperature set point set by the user using the remote control 170.

If the results from the algorithm indicate that an adjustment is required to the gas flow through the linear valve 140 in order to achieve the desired output set point, the microprocessor 130 sends a signal to the linear valve 140 to open or close the valve by some degree or amount, as required. The increased or reduced flow of gas correspondingly increases or reduces the heat produced by the burner 164. The heat energy of the flame from the burner 164 through convention to the skirt of the heat exchanger and to the tubing 114 wrapped around the skirt of the heat exchanger 116 and within the heat exchanger 116 therefore affects the conductive heat transfer between the heat exchanger, the tubing, and the water.

The linear valve 140 may be adjusted across a range of flow values from fully off to a maximum flow condition. Because the linear valve 140 may be turned fully off, it may also act as a secondary emergency cut off for the gas flow within the tankless water heater for RV 100. The solenoid valve 156, which only moves between a fully open or fully closed position, serves as the primary emergency cut off for the gas supply line. Thus, if the system exceeds a high water temperature alert or a no air flow alert, as examples, the microprocessor 130 can act to close the solenoid valve 156 and fully close the linear valve 140 to prevent system overheating. The microprocessor can also be programmed to reset itself when the various sensor readings are within permissible reset points.

After the water passes through the heat exchanger 116, the heated water flows across the downstream hot water temperature probe 120. The hot water temperature probe 120 provides a signal to the microprocessor 130 indicating the temperature of the water exiting the heat exchanger 116. As described above, the water output temperature is then used in the algorithm to adjust the gas supplied to the burner 164 by adjusting the linear valve 140 to ultimately achieve the outlet temperature set point.

If the temperature of the output hot water is too high, and the hot water temperature probe 120 sends a signal to the microprocessor 130 indicating that the temperature of the output hot water is too high, the microprocessor 130 can send a signal to the gas solenoid valve 156 to close the solenoid valve 156 and to fully close the linear valve 140, thereby turning off the burner 164.

Both the linear valve 140 and the solenoid valve 156 can be configured to default to the off position unless current is applied to them, such as in a power outage situation or when the microprocessor should fail. Thus, unless the tankless water heater for RV 100 is powered, both the linear valve 140 and solenoid valve 156 can block the flow of gas through the gas line to prevent any gas from flowing out of the burner 164 and presenting a potential safety hazard.

Heated water flows across the water temperature probe 120 and across the redundant emergency cut off switch 122 downstream of the heat exchanger. The ECO switch 122 can be of a bi-metallic switch type that is normally in an open position. The bi-metallic switch closes when the temperature of the copper tubing 114 exceeds a certain high temperature point, such as above about 150 degrees, such as about 156 degrees F. As described above, the microprocessor 130 is connected to the redundant emergency cut off switch 122. When the switch 122 activates or closes, a signal is sent from the redundant emergency cut off switch 122 to the microprocessor 130 to indicate that the redundant emergency cut off switch 122 has or is activated. Based on this signal, the microprocessor 130 can send a signal to the linear valve 140 and the solenoid valve 156 to shut off the gas to the burner 164 so that the burner 164 and the heat exchanger 116 do not overheat the water in the tankless water heater or generate too much heat to the various components.

The microprocessor 130 can also send a signal to turn off the exhaust system 128 when the burner 164 shuts down, as there are no fumes to exhaust.

The freeze prevention thermostat 118 mounted in line with the emergency cut off switch 122 is configured to send signals to the microprocessor 130 through a connection based on the position of a bi-metallic switch in the freeze prevention thermostat 118, similar to the ECO switch 122 but has different service ratings for cold temperature applications. The bi-metallic switch in the freeze prevention thermostat 118 is normally in the open position. The bi-metallic switch closes when a temperature of the copper tubing 114 to which the freeze prevention thermostat 118 falls to a pre-determined low temperature, such as below 38 degrees F. The connection of the freeze prevention thermostat 118 and the microprocessor 130 provides one way communication, with signals passing from the freeze prevention thermostat 118 to the microprocessor 130.

In one embodiment, the metals of the bi-metallic switch in the freeze prevention thermostat 118 can close the switch at 38 degrees Fahrenheit as a signal for the microprocessor to start the burner to warm the system and can open the switch above 38 degrees Fahrenheit. In other examples, the operating temperature range can differ or can be adjusted.

The freeze prevention thermostat measures the temperature of the copper tubing mounted in the tankless water heater for RV 100 downstream of the heat exchanger 116. When the temperature of the copper tubing falls below 38 degrees Fahrenheit, the switch closes, sending a signal to the microprocessor 130.

In other embodiments, the bi-metallic switch in the freeze prevention thermostat 118 can be set to activate at a temperature in the range of 33 to 50 degrees Fahrenheit, with a range of 33 to 40 degrees Fahrenheit being more preferred. In other embodiments, the bi-metallic switch in the freeze prevention thermostat can be set to de-activate at a temperature in the range of 40 to 65 degrees Fahrenheit, with a range of 50 to 60 degrees Fahrenheit being more preferred. The microprocessor 130 receives the signal from the freeze prevention thermostat 118, and based on that signal, can output signals to the linear valve 140, the solenoid valve 156, the ignitor 210, and the exhaust system 128. These signals allow the flow of gas to the ignitor 210, operate the ignitor 210 to light the burner 164, and begin operating the exhaust system 128 to exhaust the fumes created by the burner 164.

The burner 164 heats water in the heat exchanger 116 of the tankless water heater for RV 100. Because copper conducts heat efficiently, in the embodiments of the tankless water heater for RV 100 which uses copper tubing, the heating of the tubing 114 in the housing of the tankless water heater can conduct heat beyond the tankless water heater for RV 100 to other tubing sections of the vehicle, such as in the walls of the RV, to warm the interconnected tubing throughout.

The burner 164 can remain lit, thereby heating the tubing 114 and the tubing transferring that heat beyond the tankless water heater for RV 100 until the microprocessor 130 receives a second signal from the freeze prevention thermostat 118. When the copper tubing 114 reaches 58 degrees Fahrenheit or some other set point, the second metal in the bi-metallic switch causes the switch in the freeze prevention thermostat 118 to open. When the switch opens, it sends the second signal to the microprocessor 130. When the microprocessor 130 receives this second signal, it sends corresponding signals to the linear valve 140 and the solenoid valve 156 to shut off the gas, and thereby the burner 164, as well as to the exhaust system 128, turning the exhaust system 128 off as well.

Although limited embodiments of the tankless water heater for RV assemblies and their components have been specifically described and illustrated herein, many modifications and variations will be apparent to those skilled in the art. Accordingly, it is to be understood that the tankless water heater assemblies and their components constructed according to principles of the disclosed device, system, and method may be embodied other than as specifically described herein. The disclosure is also defined in the following claims.

The invention claimed is:

1. A tankless water heater for a recreational vehicle (RV) comprising:

a housing comprising a plurality of panels, a plurality of openings, and a plurality of sides including a first side;

a water inlet in fluid communication with a water run line and upstream of a seasonal flow control valve for controlling flow through the water inlet, the seasonal flow control valve having a handle for operating controlling flow and is located externally of the housing;

an inlet temperature sensor downstream of the seasonal flow control valve and upstream of a heat exchanger for heating water flowing through the water run line;

a flow sensor in line with the seasonal flow control valve for sensing water flow;

a gas inlet upstream of a linear valve, which is upstream of a solenoid valve, which is upstream of a burner, wherein the burner is configured to provide heat to the heat exchanger and the linear valve is configured to operate across a range of flow values from fully off to a maximum flow condition;

an exhaust fan to vent exhaust gas generated by the burner heating the heat exchanger;

a water outlet temperature sensor in line with the flow sensor;

an emergency cut off switch in line with the water outlet temperature sensor;

a low temperature switch in line with the water outlet temperature sensor, the low temperature switch being a bi-metallic switch that activates based on temperature of the water run line;

a water outlet at an end of the water run line; and a microprocessor powered by a fulltime power supply source of an RV in electronic communication with the flow sensor, the exhaust fan, the inlet temperature sensor and the outlet temperature sensor;

wherein the microprocessor is electrically coupled to the linear valve to adjust gas flow through the linear valve based at least in part on volume flow from the flow sensor, the inlet temperature sensor, and the outlet temperature sensor; and wherein the gas inlet, the water inlet, and the water outlet project through three of the plurality of openings on the first side of the housing.

2. The tankless water heater of claim 1, wherein the linear valve and the solenoid valve are both configured to close to block all gas flow to the burner when the microprocessor receives a signal from the emergency cut off switch.

3. The tankless water heater of claim 2, wherein one of the plurality of panels is removably attached to a frame of the housing, on the first side of the housing.

4. The tankless water heater of claim 2, wherein the low temperature switch is connected to the microprocessor is in a one-way communication.

5. The tankless water heater of claim 2, wherein the linear valve and the solenoid valve are both configured to close to block all gas flow to the burner when the microprocessor receives a low pressure signal from an air pressure switch.

6. The tankless water heater of claim 1, wherein the first side of the housing has a first side edge and a second side edge, the gas inlet is located adjacent the first side edge and both the water inlet and the water outlet are located adjacent the second side edge of the first side.

7. The tankless water heater of claim 1, wherein the emergency cut off switch comprises a bi-metallic switch that closes when water exiting the heat exchanger is above a high temperature set point.

8. The tankless water heater of claim 3, wherein the water outlet and the water inlet project through openings of the frame.

9. A method for operating a tankless water heater for a recreational vehicle (RV), said tankless water heater comprising a housing comprising a plurality of panels, a plurality of openings, and a plurality of sides including a first side, a water run line comprising a water inlet and a water outlet, a flow sensor, a heat exchanger, a burner, an exhaust fan, an air pressure switch, a water outlet temperature sensor, an emergency cut off switch, a microprocessor, a gas tubing connecting a gas inlet to a linear valve and the linear valve is connected to the burner, and wherein the gas inlet, the water inlet, and the water outlet project through three of the plurality of openings on the first side of the housing, said method comprising:

setting a water outlet temperature set point on a control panel having a housing sized for handheld, said housing of the control panel located remotely from the microprocessor and connected to the microprocessor via a cable and an I/O port;

running water through the water run line and through the heat exchanger;

adjusting gas flow through the linear valve and to the burner to operate within a range of gas flow from fully off to a maximum flow condition based on water outlet temperature exiting the heat exchanger, based on water inlet temperature entering the water inlet, and based on volumetric flow rate entering the inlet; and wherein the air pressure switch signals the microprocessor to open the linear valve if air pressure induced by the exhaust fan is sensed; and wherein the microprocessor is powered by a fulltime power supply source on an RV and parameters on the microprocessor is adjustable on the control panel.

10. The method of claim 9, further comprising shutting gas flow to the linear valve when air pressure drop is detected by the air pressure switch.

11. The method of claim 9, further comprising an ignitor located adjacent the burner to ignite a spark at the burner.

12. The method of claim 9, wherein said emergency cut off switch sends a signal to the microprocessor to close gas flow to the linear valve upon detecting a high temperature reading on the run line.

13. The method of claim 9, further comprising a temperature switch downstream of the heat exchanger, said temperature switch sending a signal to the microprocessor to allow gas flow to the linear valve upon detecting a low temperature reading on the run line.

14. The method of claim 9, further comprising a solenoid valve downstream of the linear valve, said solenoid valve and said linear valve are both programmed to shut off gas flow when said microprocessor receives a signal from the emergency cut off switch of a high run line temperature and when said microprocessor receives a signal from the air pressure switch.

15. The method of claim 9, wherein the water run line wraps around an exterior of the heat exchanger and wherein the water inlet and the water outlet are located adjacent a left edge on the first side of the housing, when looking at the first side of the housing.

16. The method of claim 9, further comprising a seasonal flow control valve located downstream of the water inlet, and wherein the water inlet and the seasonal flow control valve are both located externally of the housing.

17. The method of claim 16, further comprising adjusting a handle on the seasonal flow control valve after water flows out the water outlet.

18. The tankless water heater of claim 1, further comprising a control panel remotely located from the housing and connected to the microprocessor via a cable and I/O port, the control panel comprising a display screen and a plurality of buttons for setting parameters for the microprocessor.

19. The tankless water heater of claim 18, wherein the water inlet and the water outlet are located adjacent a left edge of the first side of the housing when looking at the first side of the housing.

20. A method for operating a tankless water heater for a recreational vehicle (RV), said tankless water heater comprising a housing, a water run line comprising a water inlet and a water outlet, a microprocessor, a gas inlet connected to a linear valve and the linear valve is connected to a burner, and wherein the gas inlet, the water inlet, and the water outlet project through three of a plurality of openings on the first side of the housing, said method comprising:

setting a water outlet temperature set point on a control panel having a housing sized for handheld, said housing of the control panel located remotely from the microprocessor and connected to the microprocessor via a cable and an I/O port, wherein said microprocessor is powered by a fulltime power supply source on an RV and parameters on the microprocessor is adjustable on the control panel;

sensing a water flow rate with a flow sensor and providing a signal to the microprocessor regarding the water flow rate;

sensing water temperature coming through the water inlet with a first temperature sensor and providing a signal to the microprocessor regarding the water temperature coming through the water inlet;

sensing water temperature coming out of a heat exchanger with a second temperature sensor and providing a signal to the microprocessor regarding the water temperature coming out of the heat exchanger;

sensing air pressure induced by an exhaust fan and providing a signal to the microprocessor regarding the air pressure;

opening the linear valve to open pass gas flow through the linear valve and igniting the burner after the air pressure signal is received by the microprocessor; and adjusting gas flow through the linear valve and to the burner to operate within a range of gas flow from fully off to a maximum flow condition based on the water temperature coming out of the heat exchanger, based on the water temperature coming through the water inlet, and based on the water flow rate; and changing gas flow through the linear valve based on a change in the water flow rate detected by the flow sensor.

21. The method of claim 20, wherein the water flow rate is changed by turning a handle on a seasonal flow control valve located downstream of the water inlet and external of the housing.

22. The method of claim 20, wherein the water run line wraps around an exterior of the heat exchanger and wherein the water inlet and the water outlet are located adjacent a left edge on the first side of the housing, when looking at the first side of the housing.

23. The method of claim 16, further comprising an inlet temperature sensor located downstream of the seasonal flow control valve and upstream of the heat exchanger.

24. The method of claim 21, further comprising an inlet temperature sensor located downstream of the seasonal flow control valve and upstream of the heat exchanger.

* * * * *